US007000339B1

(12) United States Patent
Ramun

(10) Patent No.: US 7,000,339 B1
(45) Date of Patent: Feb. 21, 2006

(54) DEMOLITION EQUIPMENT HAVING UNIVERSAL TINES AND A METHOD FOR DESIGNING A UNIVERSAL TINE

(76) Inventor: John R. Ramun, 8243 N. Lima Rd., Poland, OH (US) 44514

( * ) Notice: Subject to any disclaimer, the term of this patent is extended or adjusted under 35 U.S.C. 154(b) by 0 days.

(21) Appl. No.: 09/936,664

(22) PCT Filed: Aug. 25, 2000

(86) PCT No.: PCT/US00/23405

§ 371 (c)(1),
(2), (4) Date: Sep. 17, 2001

(87) PCT Pub. No.: WO01/16434

PCT Pub. Date: Mar. 8, 2001

Related U.S. Application Data

(60) Provisional application No. 60/151,723, filed on Aug. 31, 1999, provisional application No. 60/196,233, filed on Apr. 10, 2000.

(51) Int. Cl.
*E02F 3/96* (2006.01)

(52) U.S. Cl. ..... 37/406; 294/86.29

(58) Field of Classification Search ..... 37/406, 37/403, 405, 409, 410, 461; 414/724, 726; 294/86.4, 86.27
See application file for complete search history.

(56) References Cited

U.S. PATENT DOCUMENTS 2,870,925 A * 1/1959 Bernad et al. ..... 37/406
3,250,028 A 5/1966 Hunger et al. ..... 37/117.5
3,574,387 A * 4/1971 Hahn ..... 294/106
3,613,923 A * 10/1971 Albright ..... 294/104
4,099,761 A * 7/1978 Cullings ..... 294/106
4,285,628 A 8/1981 Jankowski ..... 414/739
4,375,345 A 3/1983 Hanson ..... 414/722
4,382,625 A 5/1983 LaBounty ..... 294/104
4,403,431 A 9/1983 Ramun et al. ..... 37/117.5
4,519,135 A 5/1985 LaBounty ..... 30/134
4,519,739 A 5/1985 Risch ..... 414/724
4,799,852 A 1/1989 Ramun ..... 414/724
4,907,356 A 3/1990 Labounty ..... 37/117.5
5,062,227 A 11/1991 De Gier et al. ..... 37/117.5
5,111,602 A 5/1992 Risch ..... 37/117.5
5,330,242 A * 7/1994 Lucky, Sr. ..... 294/106
5,472,249 A 12/1995 Fiedler ..... 294/2
5,472,308 A 12/1995 Somero ..... 414/724
5,518,359 A * 5/1996 Pratt ..... 37/406
5,544,435 A 8/1996 Somero ..... 37/405
5,553,408 A * 9/1996 Townsend ..... 37/406
5,564,885 A 10/1996 Staben, Jr. ..... 414/724
5,590,482 A 1/1997 Peterson et al. ..... 37/403
5,639,205 A 6/1997 Kaczmarczyk et al. ..... 414/723
5,649,377 A 7/1997 Tanada ..... 37/406
5,957,650 A * 9/1999 Rollo ..... 37/406
5,970,634 A * 10/1999 Dann et al. ..... 37/301

(Continued)

*Primary Examiner*—Victor Batson
(74) *Attorney, Agent, or Firm*—The Webb Law Firm

(57) ABSTRACT

A claw tine for demolition equipment includes an elongated claw tine pivotally movable about a pivot point between an open and closed position by a hydraulic cyliner. The total angular rotation of the claw tine is at least 75 degrees, generally between 75 and 100 degrees. The maximum holding force is positioned 25 to 40 degrees from the closed position. The claw tine is adapted to be incorporated into a wide varity of demolition equipment including a bucket and claw structure attachment and a variety of grapples.

34 Claims, 22 Drawing Sheets

U.S. PATENT DOCUMENTS 5,974,706 A * 11/1999 Kaczmarski et al. ..... 37/468
6,098,320 A * 8/2000 Wass ..... 37/406
6,154,989 A * 12/2000 Kaczmarski et al. ..... 37/444
6,155,619 A * 12/2000 Kirkpatrick et al. ..... 294/3
6,260,294 B1 * 7/2001 Pitcher ..... 37/403
6,287,072 B1 * 9/2001 Wasilas ..... 37/406
6,357,993 B1 * 3/2002 Burton ..... 37/406
6,453,586 B1 * 9/2002 Wolin et al. ..... 37/406

* cited by examiner

DEMOLITION EQUIPMENT HAVING UNIVERSAL TINES AND A METHOD FOR DESIGNING A UNIVERSAL TINE

This application is a 371 of PCT/US00/23405 filed Aug. 25, 2000 which claims benefit of U.S. provisional application 60/151,723 filed Aug. 31, 1999 which claims benefit of U.S. provisional application 60/196,233 filed Apr. 10, 2000.

BACKGROUND OF THE INVENTION

1. Field of the Invention

The present invention relates to demolition equipment systems and, more particularly, to claw tines for demolition equipment.

2. Background Information

The present application refers to demolition equipment, however, this equipment is also referred to as construction equipment, scrap handling equipment and the like. The description of demolition equipment is not intended to be restrictive of the equipment being referenced. In demolition equipment, it has long been known to utilize elongated extension members, referred to herein as claw tines, in a variety of equipment units. For example, there are many different machines that have buckets mounted on their front. A variety of claw tines has been developed for attachment to the buckets to improve the operation of these equipment units. Examples of the wide variety of claw tine attachments for various buckets can be seen in U.S. Pat. Nos. 5,639,205; 5,590,482; 5,564,885; 5,544,435; 5,472,308; 5,111,602; 4,382,625; 4,519,739; 4,375,345 and 4,285,628. Additionally, the Applicant's earlier invention disclosed a self-contained demolition bucket attachment using claw tines in U.S. Pat. No. 4,799,852. In addition to bucket type equipment, elongated claw tines are utilized opposing each other to form a grapple. Grapples are generally used for gripping and moving the work. Within the context of the present application, grapples are distinguished from the bucket attachments in that the grapples have the tines operating against each other (i.e., opposed) as compared to operating against a bucket.

There have been a wide variety of existing claw tines for demolition equipment units. To date, there has not been sufficient consideration given to how changes in the geometry of the claw tine can effect the operation. For example, if the holding force of a given demolition equipment unit using a claw tine was not sufficient, then the hydraulic piston powering the claw tine was simply increased in size to provide more force. This is not the most efficient way of addressing the problem and the resulting device may be impractical and expensive. Additionally, the existing claw tines have been designed to be associated with a given piece of construction equipment and were not adapted for other uses. Finally, the attachment systems utilized in existing claw tines were not efficient and many required additional machining in order to get the claw tines to fit on an existing bucket or other existing component structure.

It is an object of the present invention to overcome the aforementioned problems of the prior art. It is a further object of the present invention to provide a claw tine for demolition equipment which optimizes the design considerations of the respective geometry of the claw tine. A further object of the present invention is to provide a claw tine which is easily manufactured and attached to existing equipment. A further object of the present invention is to provide a claw tine which is adaptable for use in a variety of distinct demolition equipment units to provide a demolition equipment system.

SUMMARY OF THE INVENTION

The above objects are achieved by a claw tine for a demolition equipment and the demolition equipment system according to the present invention. The claw tine for demolition system according to the present invention includes an elongated claw tine body pivotally movable about a pivot point between an open position and a closed position. A hydraulic cylinder is provided for moving the claw tine body between the open position and the closed position with a fixed end of the hydraulic cylinder secured to a base and a cylinder rod end of the hydraulic cylinder secured to the claw tine body. The ratio of the length of the hydraulic cylinder when the claw tine body is in the closed position to the distance between the pivot point and the securement of the cylinder rod end of the hydraulic cylinder to the claw tine body is between 0.7 and 0.9.

The total angular rotation of the claw tine may be designed to be at least 75 degrees, preferably at least 85 degrees, or generally between 75 and 100 degrees. Additionally, the claw tine may provide a maximum holding force located at 25 to 40 degrees from the closed position, preferably about one third from the closed position.

Another aspect of the present invention is that the claw tine may be secured to the demolition equipment through a support frame and a support frame receiver. The support frame includes a bushing member for forming the pivot point for the claw tine body and at least one support frame plate attached thereto. The support frame plate includes a locking pin aperture for securing the support frame to the demolition equipment through the support frame receiver and a securing pin aperture for securing a fixed end of the hydraulic cylinder to the support frame. The support frame receiver is a single plate structure attached to the demolition equipment and including an opening for receiving the bushing member of the support frame and a locking pin aperture aligned with the locking pin aperture of the support frame for securing the support frame to the demolition equipment. Each claw tine may have a removable claw tip at a distal end of the claw tine body.

The claw tine may be associated with a parallel spaced claw tine and a connecting structure therebetween to form a claw structure. The connecting structure may include a grid and an end member extending between and coupled to the spaced claw tines.

The present invention provides for a demolition equipment system including a plurality of equipment bases with each equipment base forming at least part of a distinct demolition equipment unit, and a plurality of claw tines, with each claw tine selectively, removably attached to each equipment base. The plurality of equipment bases may include at least one bucket and at least one grapple base. The grapple base may, for example, be formed as a two-tine grapple, three-tine grapple, four-tine grapple, or claw structure grapple. The two-tine grapple has two opposed claw tines positioned 180 degrees from each other. The three-tine grapple has three opposed claw tines positioned 120 degrees from each other and the four-tine grapple has four opposed claw tines positioned 90 degrees from each other. The claw structure grapple includes two opposed claw structures, with each claw structure formed of two parallel spaced claw tines with a connecting structure therebetween.

These and other advantages of the present invention will be clarified in the Description of the Preferred Embodiments taken together with the attached figures wherein like reference numerals represent like elements throughout.

DESCRIPTION OF THE PREFERRED EMBODIMENTS

Figure 1:
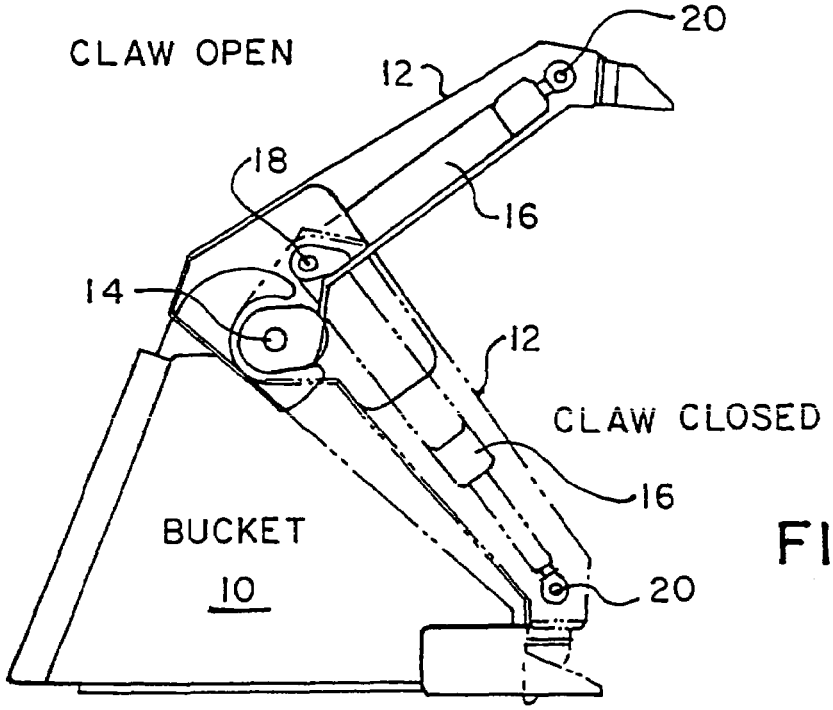
FIG. 1 schematically illustrates a bucket with a claw structure according to the present invention.

FIG. 1 schematically illustrates a bucket 10 with a claw structure according to the present invention coupled thereto. The claw structure includes at least one claw tine 12 pivotally attached to the bucket 10 for movement about a pivot point 14. A hydraulic cylinder 16 is positioned generally within the claw tine 12 and has one end thereof pinned to the bucket 10 at a fixed end 18 and secured to the claw tine 12 at a cylinder rod end 20. The claw tine 12 of the present invention encloses and protects the hydraulic cylinder 16. The hydraulic cylinder 16 provides power for moving the claw tine 12 between the open and closed positions illustrated in FIG. 1.

Figure 2:
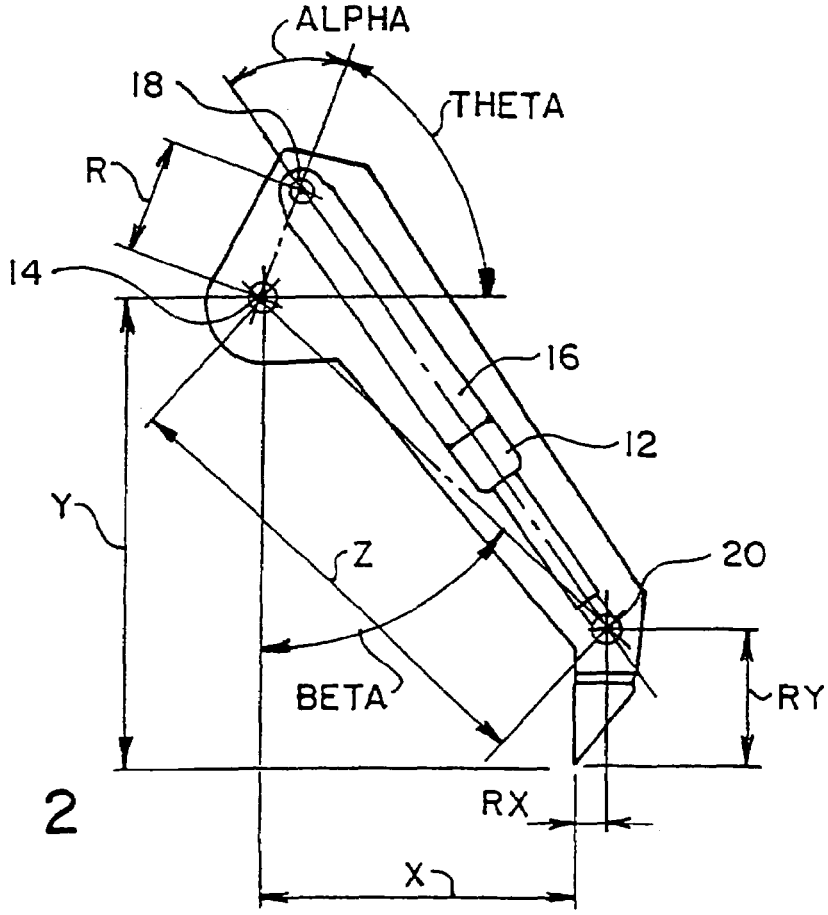
FIG. 2 illustrates the linkage parameters associated with a claw tine of the claw structure illustrated in FIG. 1.

The specific geometry of the claw tine 12 according to the present invention allows the claw tine 12 to be easily adapted for a wide variety of construction equipment as will described hereinafter. FIG. 2 better illustrates the important linkage parameters associated with the claw tine 12. The distance between the main pivot point 14 and the fixed end 18 of the hydraulic cylinder 16 is a lever arm R of the linkage. THETA is the relative angular orientation of the fixed end 18 of the cylinder 16 to the pivot point 14 measured from the horizontal. The lever arm R and angular orientation THETA represent two linkage parameters having a major effect on the output characteristics of the claw tine 12 and associated claw structure. The location of the cylinder rod end 20 with respect to the pivot point 14 also has a major effect on the performance of the claw tine 12 and associated claw structure. This relative relationship is defined by as distance Z between the pivot point 14 and the cylinder rod end 20 as well as the relative angle therebetween labeled BETA, which is measured from vertical as shown in FIG. 2. A vertical distance Y between the pivot point 14 and the tip of the claw tine 12 is the lever arm of the holding force developed at the tip of the claw tine 12. For the purposes of designing the claw structure, it will be assumed that the holding force is measured at the end of the tip of the claw tine 12, orientated at the angle perpendicular to RY. A distance X is the horizontal distance from the pivot point 14 to the leading edge of the end of the claw tine 12. FIG. 2 illustrates values RX and RY which represent relative distances from the cylinder rod end 20 to the end of the tip of the claw tine 12. The size and shape of the end of the claw tine 12 dictate a minimum distance from the end of the claw tine 12 and the cylinder rod end 20.

Another important parameter labeled in FIG. 2 is the angle between the center line of the hydraulic cylinder and the lever arm R of the claw structure. For the purpose of the following calculations, this angle will be referred as ALPHA which will vary as the claw tine 12 moves from the closed position to the open position. This angular relationship will have an effect on the holding force developed in the various positions. The holding force at the end of the claw tine 12 can be generally calculated by the following equation:

$$\text{Holding Force}=(R*FC*\sin(\text{ALPHA}))/Y;$$

where $FC$=(# of cylinders)×(0.786)(Diameter)(Diameter)(Hydraulic Pressure).

As evidenced by the above-cited equation, the holding force will increase as the claw opens from the fully closed position to a maximum value and then decreases until the fully open position is reached. The claw tine 12 can be designed so that the sinusoidal shaped force versus angular position curve maximizes the holding force in a desired location by varying the main geometric parameters of the linkage.

The total possible angular rotation of the claw tine 12 with respect to the bucket 10, or other associated base, is controlled by two main considerations. First, care must be taken to ensure that the claw tine 12 does not strike any part of the host machine during any possible movement of the bucket 10 or other structure. Second, the total possible rotation of the claw tine 12 has to be limited due to the hydraulic cylinder 16, once selected. The amount of stroke that can be obtained from a hydraulic cylinder is limited by its fully retracted length and the size of the internal components of the cylinder. Therefore, the cylinder that fits the design when the cylinder is fully retracted (claw tine 12 in the fully opened position) may not have sufficient stroke to produce the desired total rotation of the claw tine 12.

In designing a specific claw tine 12 it is important to review how the specific claw parameters, and changes thereto, effect the operation of the claw tine 12. For example, as the magnitude of the lever arm R is increased, all other variables held constant, the magnitude of the holding force at all angular positions of the claw tine 12 is also increased. The angular location of the maximum value of this force moves closer to the open position as the lever arm R increases in magnitude. Both the cylinder stroke needed and the length of the cylinder in the closed position will increase as the lever arm R increases, while the length of the cylinder 16 in the open position will decrease as necessary to achieve the desired opening.

The magnitude of the maximum holding force is not a function of angle THETA, but the angular position of the claw tine 12 where the maximum holding force occurs is effected by THETA. Increasing the magnitude of THETA causes the sinusoidal force curve to shift away from the closed position toward the open position of the claw tine 12. Consequently, increasing THETA increases the holding force at the open position and decreases the holding force at the closed position. Changes in the angle THETA have only a minor effect on the length of the stroke and the cylinder 16 in either position. How the change in the angle THETA will effect the length of the stroke of hydraulic cylinder 16 and the length of the cylinder 16 will vary depending on the value of the distance Z. Varying the distance Z does not effect the magnitude of the holding force, but increasing this distance will shift the holding force curve toward the claw tine 12 closed position. Thus, the force at the closed position and the force at the open position decreases as the distance Z increases. The cylinder lengths in both the open and closed positions increase as distance Z increases. The magnitude of the distance Z has only a minor effect on the needed cylinder stroke and it may increase or decrease the stroke depending on the values of R and BETA discussed above.

The angle BETA has an initial value and BETA increases from the initial value as the claw tine 12 rotates from the closed position to the open position. The total change in BETA is equal to the total angular rotation of the claw tine 12 and the associated claw structure. The initial value of BETA in the closed position has an effect on the operating parameters of the design. Increasing the initial value of BETA shifts the holding force curve toward the closed claw tine position having the same type of effect as increasing the distance Z discussed above. Changes in the angle BETA cause a relatively greater shift in the holding force curve than similar percentage changes to the distance Z. Change in the initial angle BETA have only a minor effect on the needed cylinder stroke and cylinder lengths in the open and closed positions. Whether these lengths increase or decrease depends on the value of THETA as well as the value of BETA.

The values of the distances X and Y are largely a function of the size and shape of the associated machine. If the claw tine 12 is associated with a given bucket 10, these values are largely predetermined. Movement of the location of the pivot point 14 can vary the values for X and Y slightly for a given structure. Increasing the value of Y, the lever arm of the holding force, reduces the magnitude of the holding force in all angular positions of the claw tine 12. The distance X effects the initial value of the angle BETA such that increasing X, increases the initial angle BETA. The movement of the pivot point 14 is limited by interference problems in typical bucket configurations. In general, the overall performance of the claw tine 12 will improve if the value of Y is as small as possible while avoiding the above-mentioned interference. Increasing the value of X increases the length of the cylinder 16 in the open claw position. Increasing the value of X can help overcome possible limitations to the desired total angular rotational values of the claw tine 12 due to the limitations of the hydraulic cylinder 16 discussed above.

The variables RX and RY will also effect the distance Z and initial angle BETA. Increasing RX increases the value of Z and the initial value of BETA. Increasing the value of RY decreases the value of Z while increasing the initial value of BETA. As Z decreases in magnitude, the total possible angle of rotation of the claw tine 12 will usually be limited by the closed cylinder length and the required cylinder stroke. Under this condition, the distance RY should be decreased and the value RX should be increased to help overcome this problem.

In addition to the geometric parameters discussed above, the force of the claw structure formed by one or more claw tines 12, is determined by the hydraulic cylinders 16. It is possible to, design a claw structure with a different number of hydraulic cylinders 16.

Therefore, the holding force can be increased by increasing the diameter of, or the number of, hydraulic cylinders used in the design of a claw structure. Increasing the diameter of the cylinders in total claw structures will increase the opening and closing times for the structure. The opening and closing times, also known as cycle times, for a given claw structure are also a function of the hydraulic fluid flow rate produced by the pumps of the associated machine. The hydraulic pressure and pump flow rate are determined by the design of the host machine and are not specifically design variables considered in the claw tines 12 for the specific claw structure geometry.

The cycle time for the claw structure can be calculated by summing the following equations:

Time to Open=(Number of Cylinders)(0.260)(Bore Area)(Stroke)/(Fluid Flow Rate)

Time to Close=(Number of Cylinders)(0.260)(Rod Area)(Stroke)/(Fluid Flow Rate)

The bore area is the piston diameter area and the rod area is the bore area minus the rod diameter area. The total cycle time is the time to open and the time to close.

The geometric parameters most effecting the magnitude of the holding forces are the length of the lever arm R and the holding force lever arm Y. Since the value for the variable Y is largely a function of the bucket or other structure on which the claw tine is associated, the lever arm R is preferably made as large as possible for a given claw tine 12. Increasing the magnitude of R increases the need for cylinder stroke and decreases the cylinder length in the open position. The magnitude of R is effectively limited by both the cylinder length considerations and possible structural interference with the associated machine when in the fully open position. Another way for the designer to increase the holding force is by increasing the size and number of hydraulic cylinders. The limiting factors on this design consideration are the increased cycle time of the assembly along with the increased cost of the larger hydraulic components.

A designer of the claw tine 12 according to the present invention can position the location of the holding force curve with respect to the angular position of the claw tine 12 by varying the geometric parameters THETA, Z and BETA as discussed above. The total angle of rotation that the claw tine 12 and the associated claw structure can undergo from the closed to open position is limited by the length of the stroke and the open positioned cylinder lengths along with possible interferences with the associated machine. When the desired rotation is limited by a cylinder length, it can be desirable to increase the values of X, Y and RX, while decreasing the value of RY to minimize these issues.

The above design considerations were carefully reviewed in constructing the claw tine 12 according to the present invention. Carefully balancing all of the considerations, the improved claw tine 12 according to the present invention provides the value of the angle ALPHA in the open position such that the maximum holding force of the structure will occur when the claw tine is between 25 and 40 degrees from the closed position. Maximizing the holding force versus the angular position of the claw tine in this specific range will result in the best overall performance of the demolition equipment having a claw tine 12 according to the present invention. Furthermore, another important design consideration of the present invention is having a value of the geometric ratio between the retracted cylinder length divided by the distance Z fall generally between 0.7 and 0.9. This ratio will control the symmetry of the various sizes for the claw tine 12 and allow for all of the designs to have a maximum total angular rotation generally between 75 and 100 degrees. The claw tine 12 is specifically designed to satisfy these design considerations. Additionally, these design considerations allow for the claw tine 12 to be adapted for use on a bucket 10 as shown in FIG. 1 or a wide variety of other configurations as will be described hereinafter.

Figure 3:
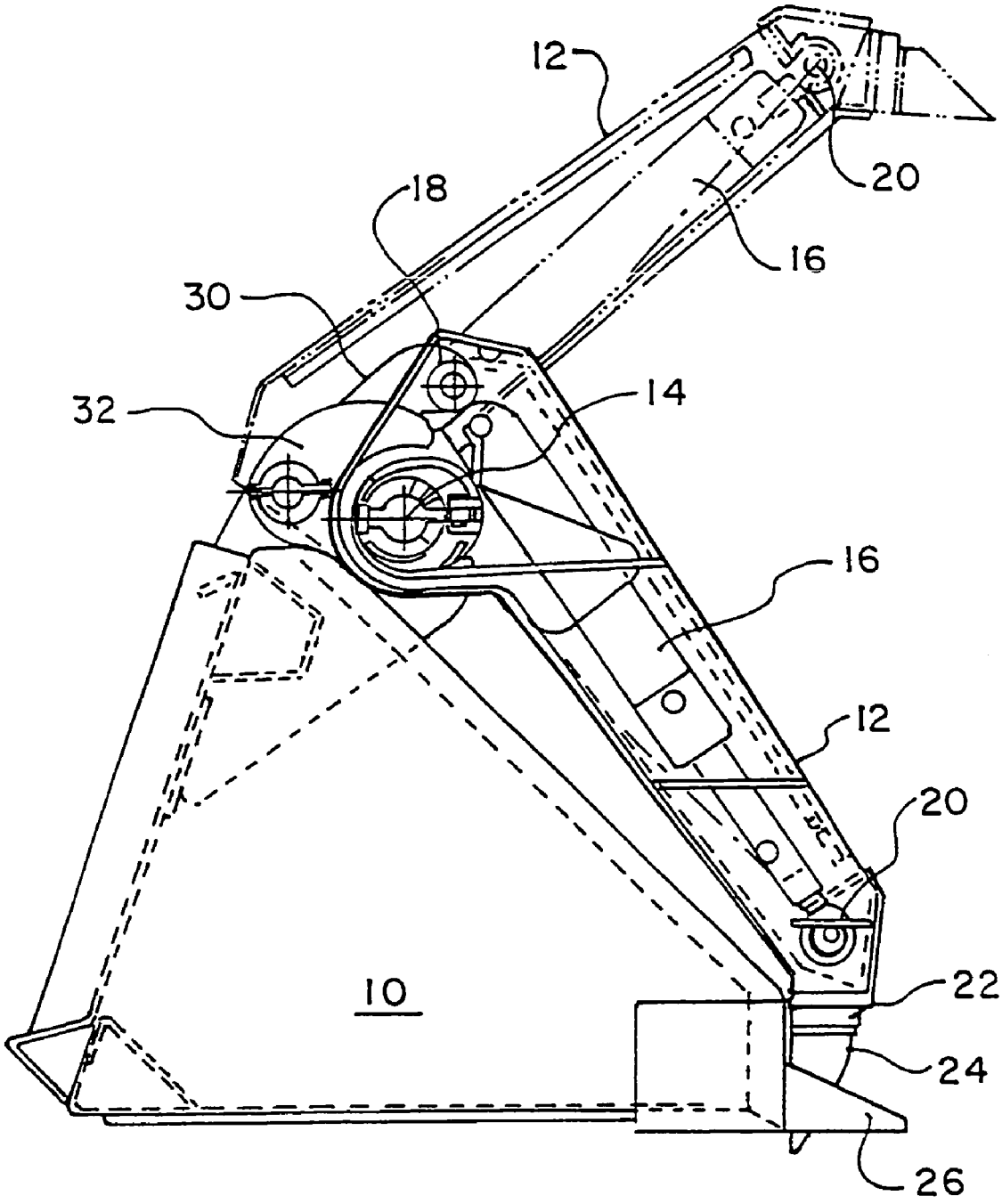
FIG. 3 is a side view similar to FIG. 1 of a bucket with a claw structure according to the present invention.
Figure 4:
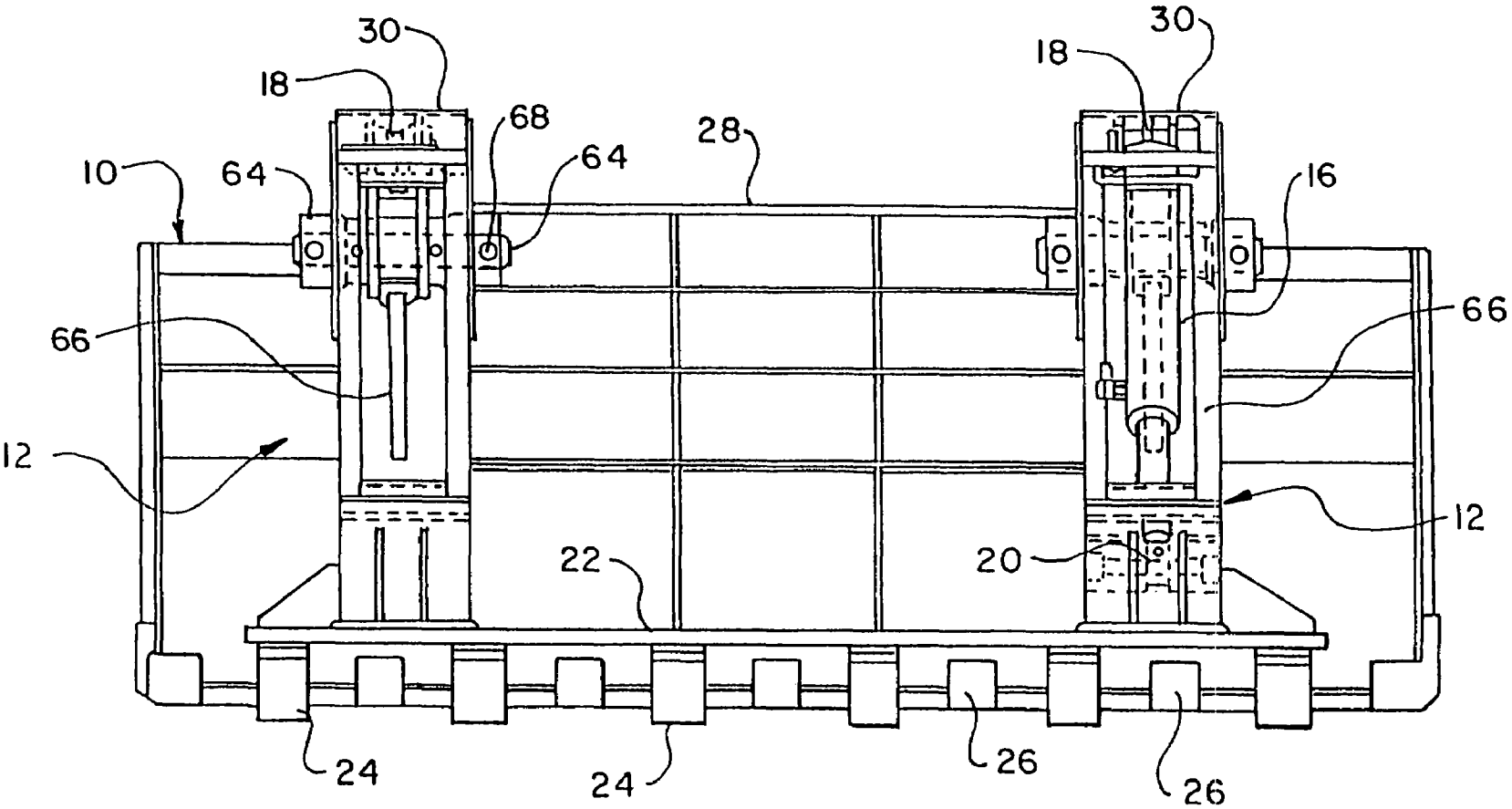
FIG. 4 is a front view of the bucket and claw structure illustrated in FIG. 3.

FIG. 3 is a detailed view of the bucket 10 with a claw structure according to the present invention incorporating a pair of claw tines 12. As better shown in FIG. 4, the tip of each claw tine 12 is formed of a removable end member 22 attached to and extending between the parallel spaced claw tines 12. The end member 22 has a plurality of spaced teeth 24 extending therefrom. The teeth 24 of the end member 22 are positioned between teeth 26 of the bucket 10. The claw structure additionally includes a grid 28 having openings of a given size extending between and removably attached to the pair of claw tines 12. The pair of claw tines 12, end member 22 with associated teeth 24, and grid 28 combine to form the claw structure associated with the bucket 10.

Figure 7:
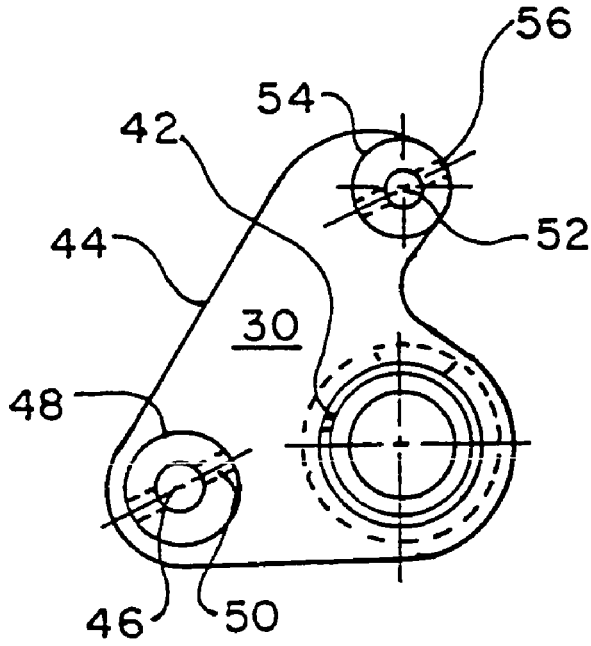
FIG. 7 is a side view of a support frame for attaching a claw tine of the claw structure of FIG. 3.
Figure 8:
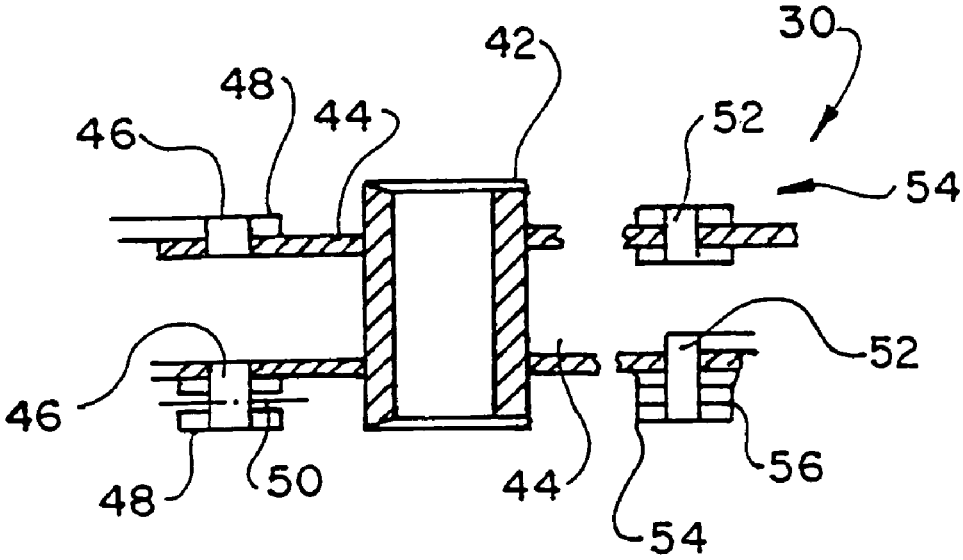
FIG. 8 is a sectional view of the support frame taken along line A—A of FIG. 7.
Figure 9:
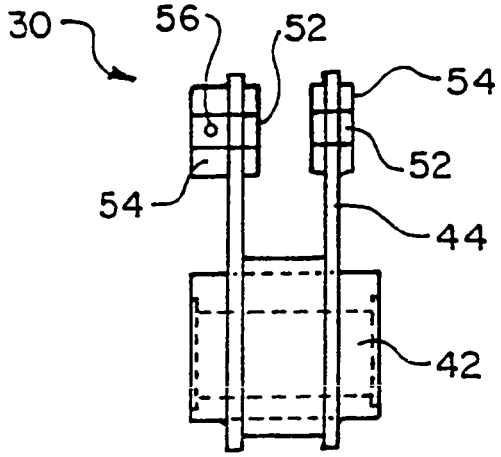
FIG. 9 is a front view of the support frame illustrated in FIG. 7.
Figure 10:
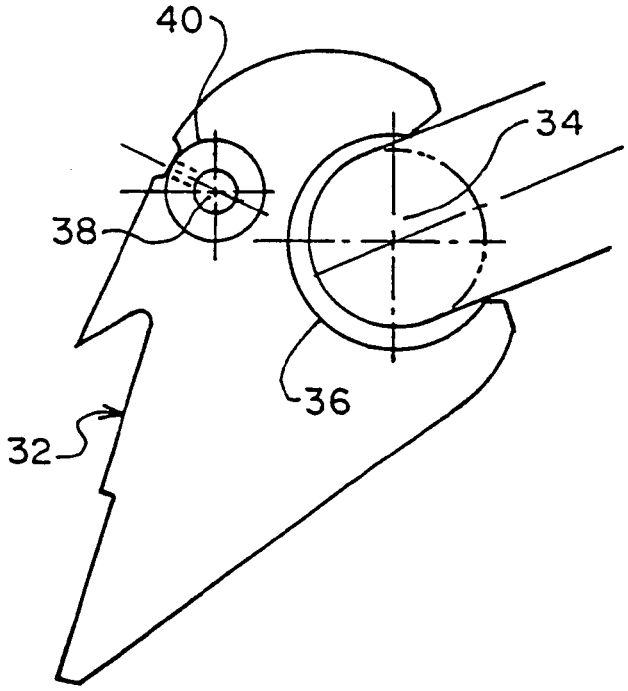
FIG. 10 is a side view of a support frame receiver for attachment of a claw tine of the claw structure of FIG. 3.
Figure 11:
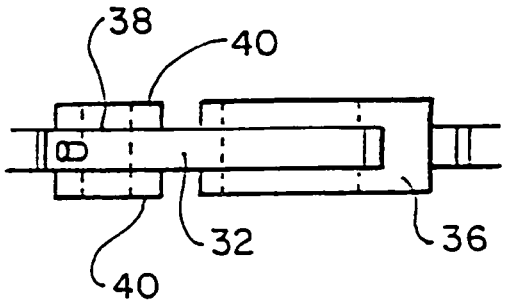
FIG. 11 is a plan view of the support frame receiver of FIG. 10.

Each claw tine 12 is secured to the bucket 10 through a support frame 30 shown in detail in FIGS. 7–9 and a support frame receiver 32 which is shown in detail in FIGS. 10 and 11.

The support frame receiver 32 is welded to the bucket 10 or otherwise securely attached in the desired location. The support frame receiver 32 is a single plate having a generally C-shaped opening 34 at one end thereof which receives the structure forming the pivot point 14 as will be described hereinafter. An enlarged portion 36 of the support frame receiver 32 surrounds the C-shaped opening 34 and is wider than the remaining portions of the plate forming a support frame receiver 32 to provide increased stability to the associated claw tine 12. The enlarged portion 36 surrounding the opening 34 can be made integral with the remaining portions of the support frame receiver 32 or, may be made as a separate replaceable element if this location is determined to be in an area of wear. The support frame receiver 32 additionally includes a locking pin aperture 38 at a position generally behind the C-shaped opening 34. An enlarged portion 40 surrounds the locking pin aperture 38 as illustrated in the drawings.

As shown in FIGS. 7–9, the support frame 30 includes a cylindrical bushing member 42 and a pair of support frame plates 44 extending therefrom. The support frame plates 44 include a locking pin aperture 46 and support structure 48 surrounding the locking pin aperture 46 on each support frame plate 44. One support structure 48 can include a cross pin aperture 50 as shown in FIG. 8. The support frame plates 44 additionally include a securing pin aperture 52 for receiving the fixed end 18 of the hydraulic cylinder 16. The securing pin aperture 52 is surrounded by support structure 54 on each support frame plate 44. One support structure 54 includes a cross pin aperture 56 extending therethrough as shown in FIG. 8.

Figure 5:
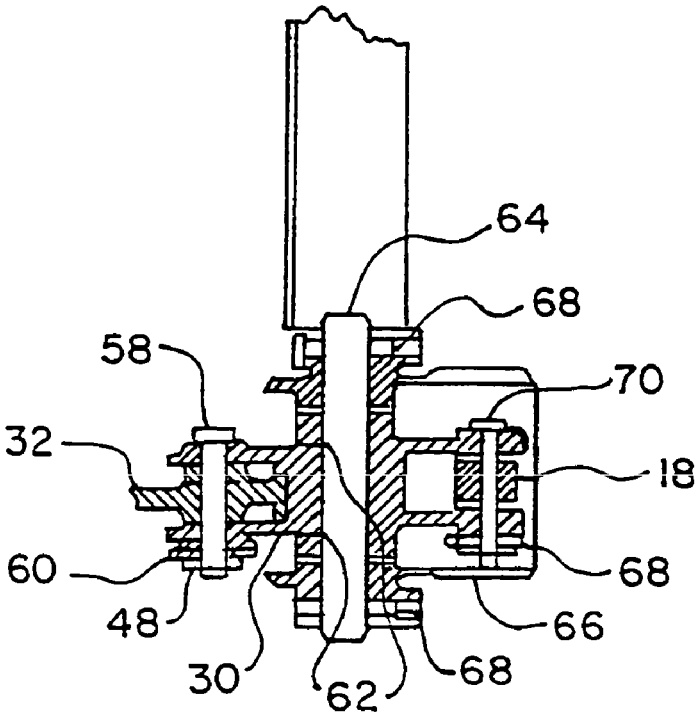
FIG. 5 is a sectional view taken along line A—A of FIG. 3.

As shown in FIG. 5, each claw tine 12 is secured to the bucket 10 through the support frame 30 and support frame receiver 32. As noted above, the support frame receiver 32 is welded or otherwise secured to the bucket 10. The support frame 30 is positioned so that the bushing member 42 is received in the C-shaped opening 34 of the support frame receiver 32 such that the locking pin aperture 46 aligns with locking pin aperture 38. Locking pin 58 extends through the locking pin aperture 38 and the locking pin aperture 46 securing the support frame 30 and the associated claw tine 12 to the bucket 10. A cross locking member 60 can extend through the cross pin aperture 50 to prevent the locking pin 58 from sliding out of engagement.

The bushing member 42 provides for the pivot point 14 of the claw tine 12. The bushing member 42 receives a pair of replaceable bushings 62 which surround a pivot pin 64. The pivot pin 64 is attached to the claw tine body 66 through cross locking members 68 such as conventional bolts.

The fixed end 18 of the hydraulic cylinder 16 is secured to the support frame 30 by securing pin 70 extending through securing pin apertures 52 in the support frame plates 44. The securing pin 70 can be held in position by a cross locking member 68 extending through cross pin aperture 56.

Figure 6:
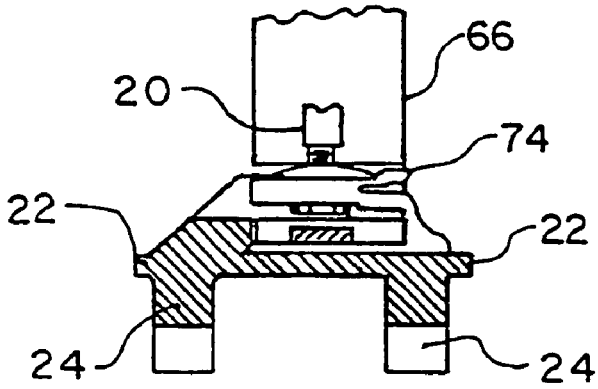
FIG. 6 is a sectional view taken along line C—C of FIG. 3.

FIG. 6 illustrates the connection of the cylinder rod end 20 of the hydraulic cylinder 16 to the claw tine body 66 through an attachment pin 74. The attachment pin 74 may be in the form of a convention nut and bolt or other type attaching pin configuration as known in the art. FIG. 6 additionally illustrates the abutment of the end member 22 to the claw tine 12. The end member 22 may be welded or otherwise attached to the claw tine 12. Within the context of demolition equipment welding, a component is also a "releasable connection".

Figure 12:
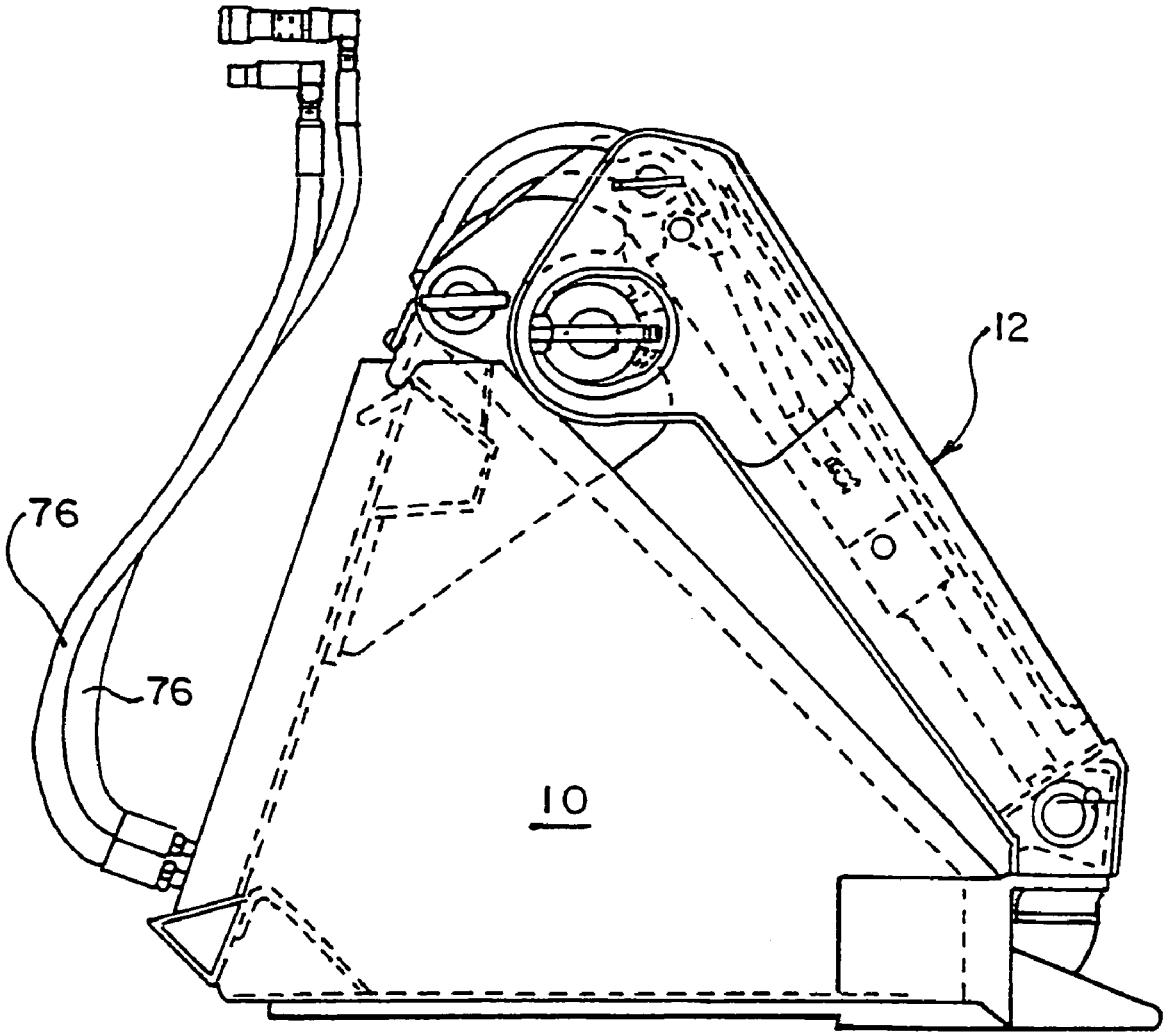
FIG. 12 is a side view similar to FIG. 3 illustrating the hydraulic lines for the claw structure of FIG. 3.
Figure 13:
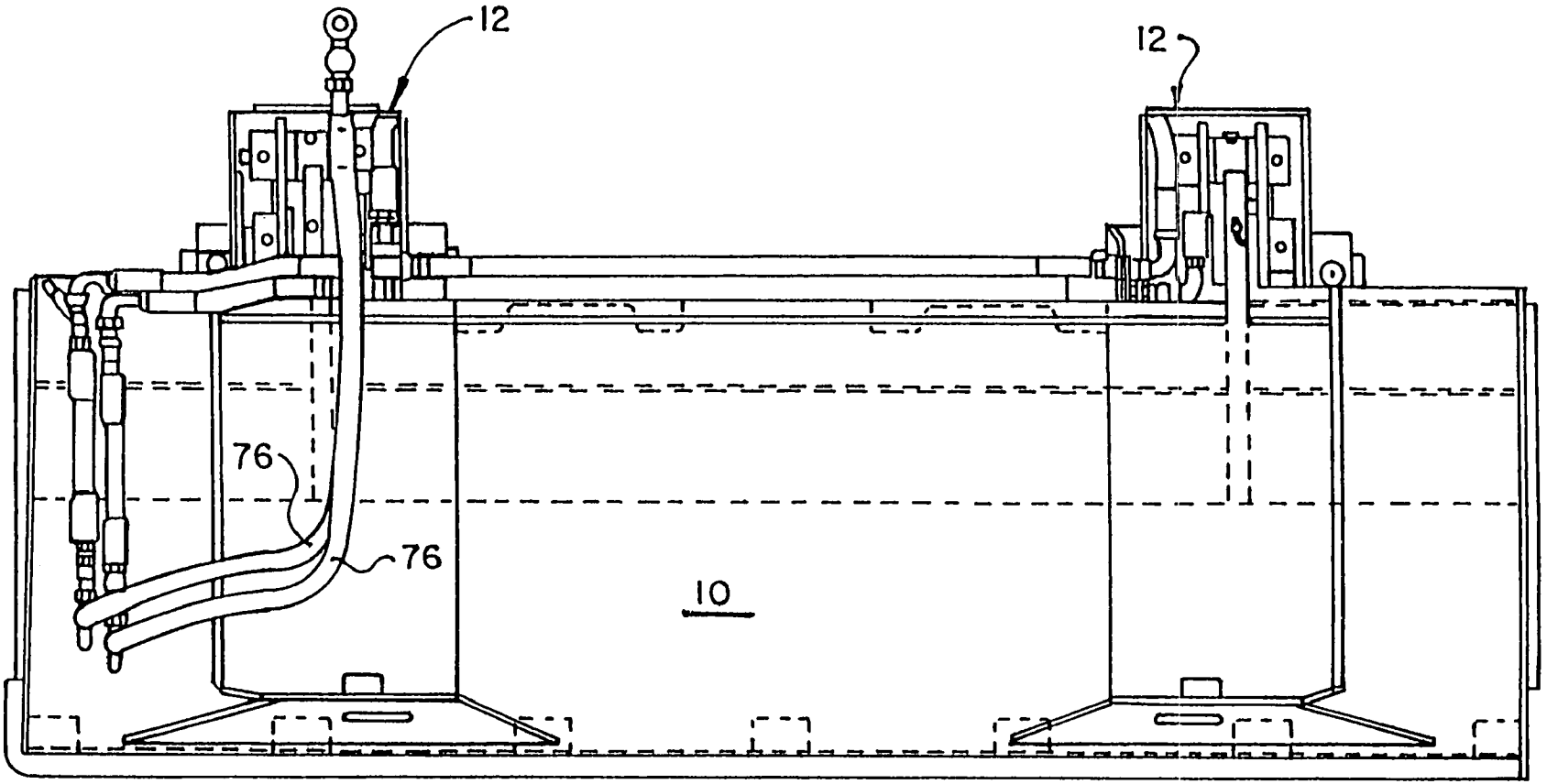
FIG. 13 is a rear view of the bucket and claw structure of FIG. 12.
Figure 14:
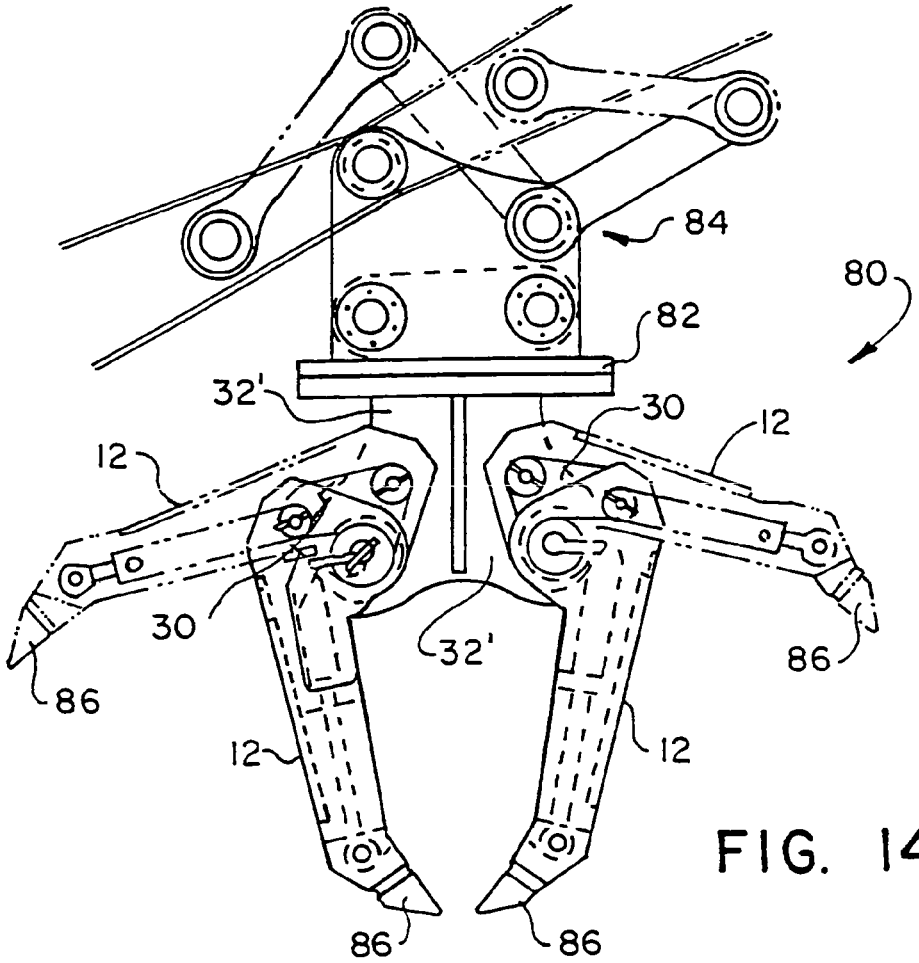
FIG. 14 is a side view of a two-tine grapple according to the present invention.
Figure 15:
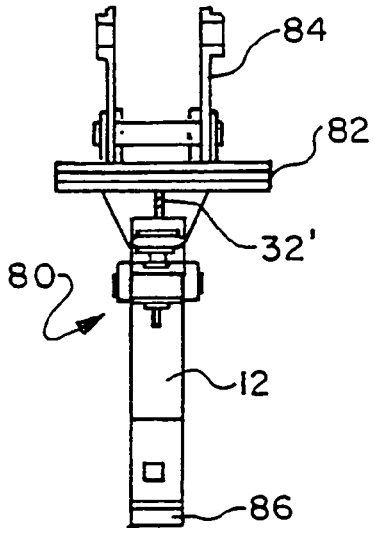
FIG. 15 is an end view of the grapple of FIG. 14.
Figure 16:
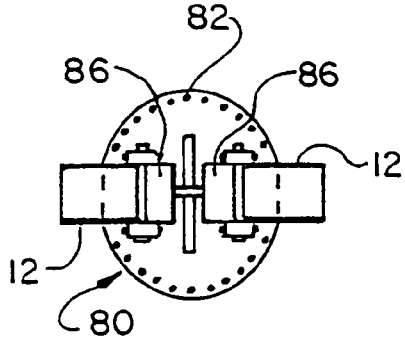
FIG. 16 is a bottom view of the grapple of FIG. 14.

The hydraulic cylinder 16 for operating the individual claw tines 12 and the associated claw structure is a double acting cylinder controlled in the conventional fashion. FIGS. 12 and 13 illustrate the positioning of the hydraulic elements for individual hydraulic cylinders 16 of the claw tines 12. As shown in FIGS. 12 and 13, each side of the piston of hydraulic cylinder 16 is fed with a hydraulic line 76. As shown in FIGS. 12 and 13, the hydraulic lines 76 do not interfere with the operation of the bucket 10.

The claw tine 12 of the present invention is designed to be utilized in a wide variety of construction equipment. The end members 22 and grid 28 are specifically provided to be removably coupled to the claw tine 12 so that the claw structure can be easily disassembled for repair and/or incorporation of the claw tines 12 into other construction equipment.

Figure 17:
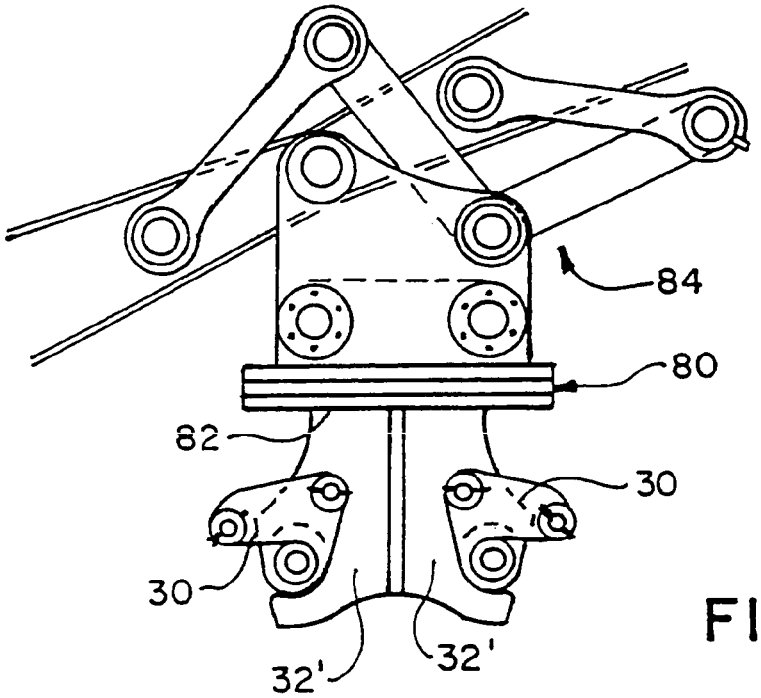
FIG. 17 is a side view of a grapple base and support frames for the grapple of FIG. 14.

FIGS. 14–17 illustrate a two-tine grapple 80 utilizing the claw tines 12. The two-tine grapple 80 includes a (powered or non-powered) rotatable base 82 which includes two integral support frame receivers 32' positioned 180 degrees relative to each other as illustrated in FIG. 17. Each claw tine 12 is attached to the rotatable base 82 through support frame 30 and support frame receiver 32' in the same manner discussed above in connection with bucket 10. The rotatable base 82 will be supported and controlled in a conventional fashion. The support for the rotatable base 82 is schematically illustrated at 84. In the two-tine grapple 80, the ends of the individual claw tines 12 are provided with individual replaceable tips 86.

Figure 18:
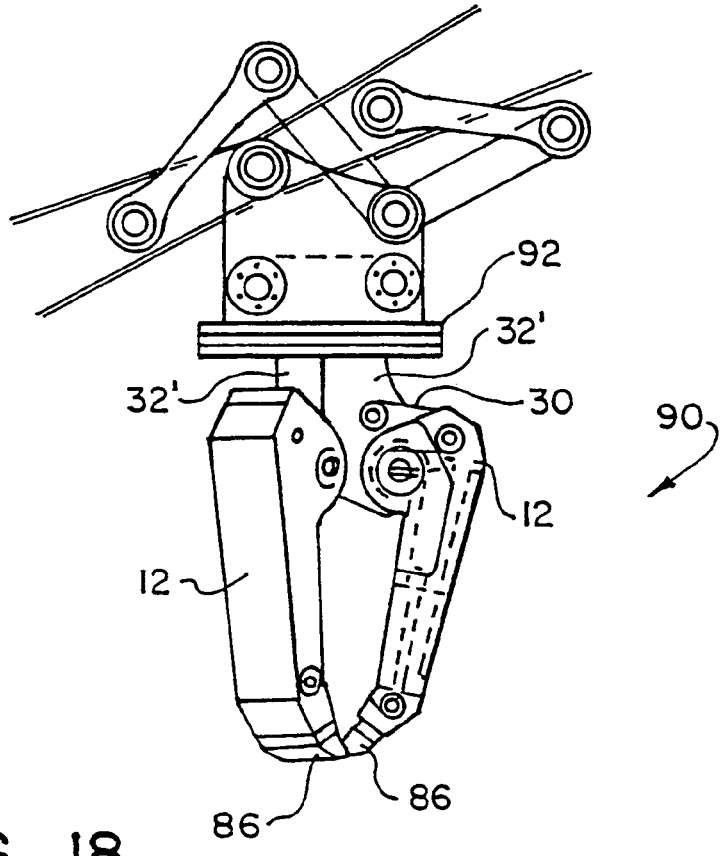
FIG. 18 is a side view of a three-tine grapple according to the present invention.
Figure 19:
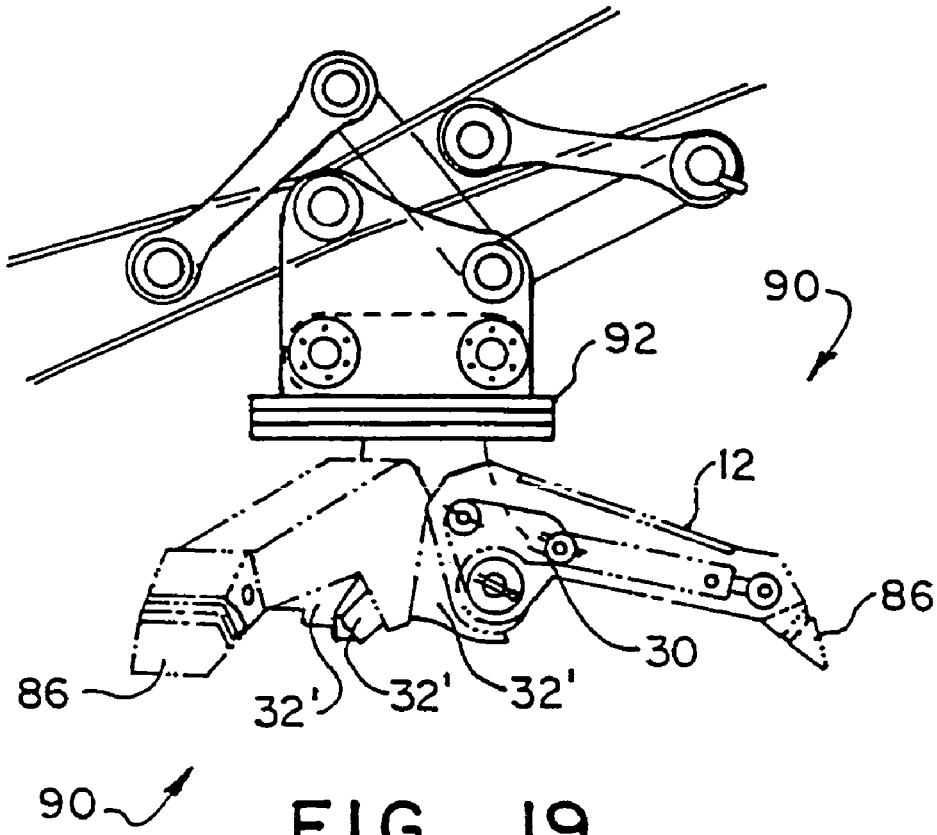
FIG. 19 is a side view of the three-tine grapple illustrated in FIG. 18 with claw tines in an open position.
Figure 20:
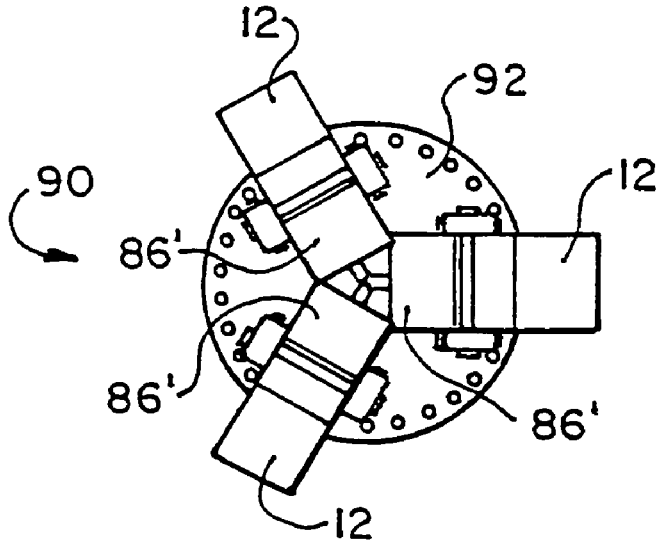
FIG. 20 is a bottom view of the three-tine grapple illustrated in FIG. 18.

FIGS. 18–20 illustrate a three-tine grapple 90 utilizing the claw tines 12 of the present invention. The three-tine grapple 90 is similar to the two-tine grapple 80 discussed in FIGS. 14–17 and includes a rotatable base 92. Rotatable base 92 includes three integral support frame receivers 32' positioned at 120 degrees relative to each other. The three claw tines 12 forming the three-tine grapple 90 may utilize replaceable tips 86 or may have a modified tip 86' as shown in FIG. 20. The modified tips 86' have beveled edges to permit a closer closed position of the tines 12.

Figure 21:
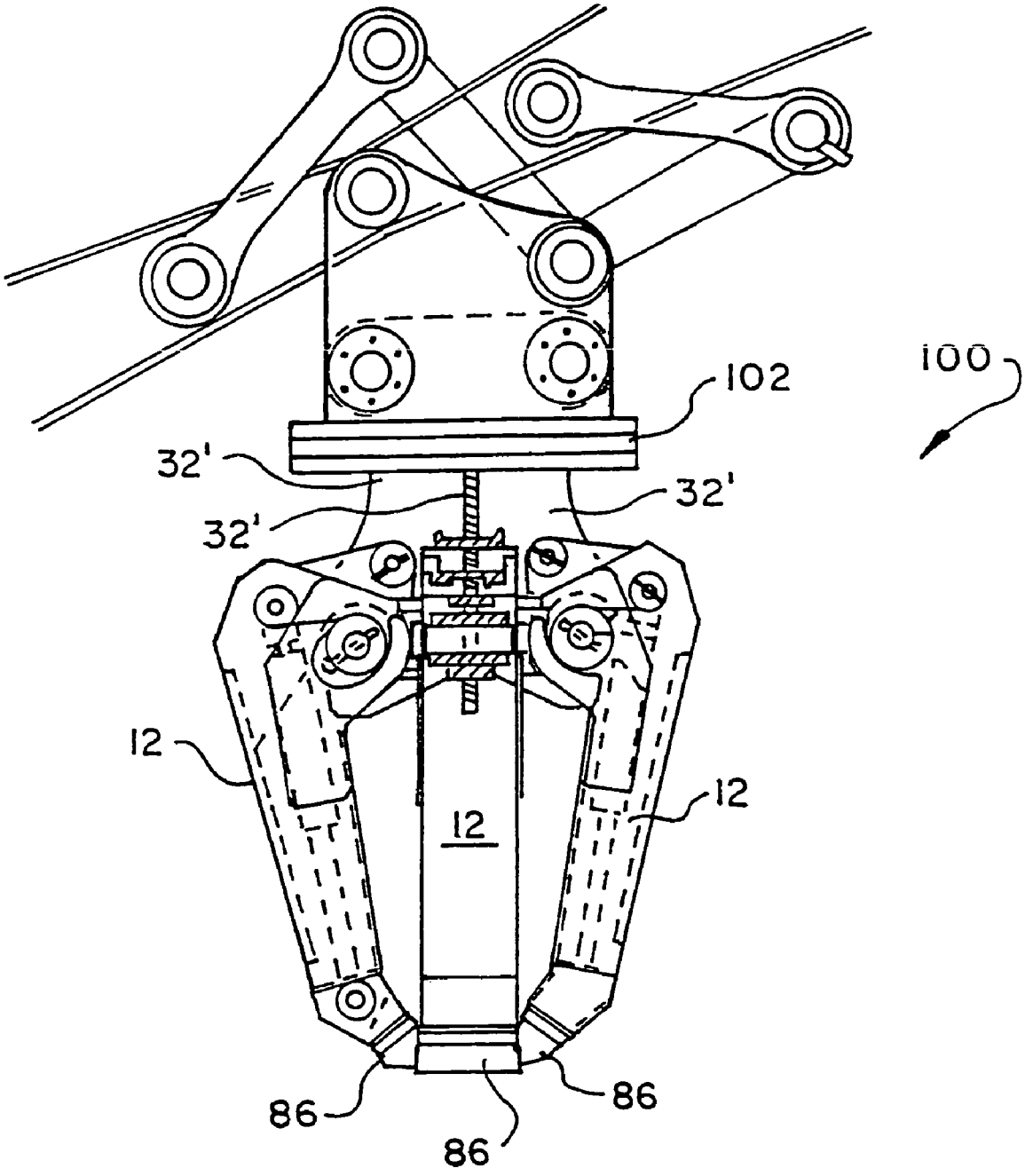
FIG. 21 is a side view of a four-tine grapple according to the present invention.
Figure 22:
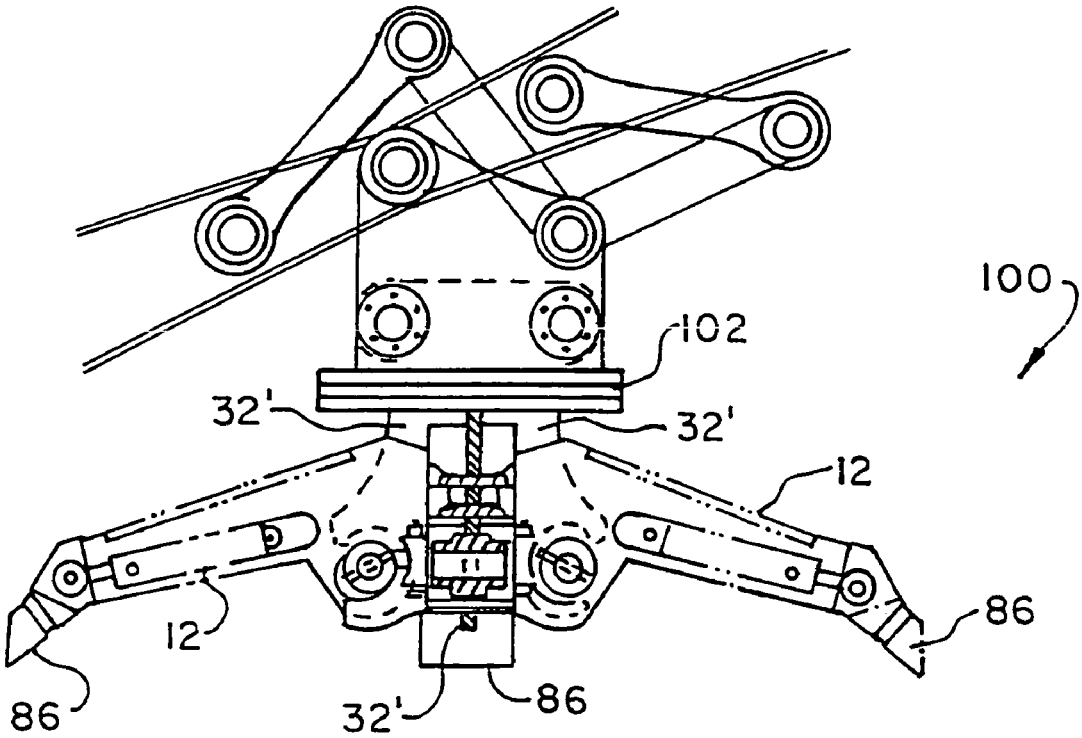
FIG. 22 is a side view of the four-tine grapple illustrated in FIG. 21 with the claw tines in an open position.
Figure 23:
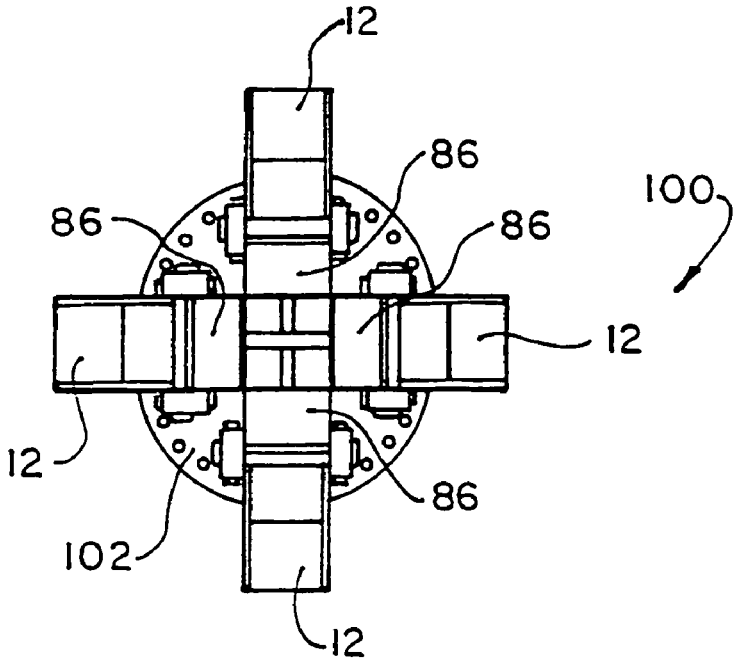
FIG. 23 is a bottom view of the four-tine grapple illustrated in FIG. 21.

FIGS. 21–23 illustrate a four-tine grapple 100 utilizing four claw tines 12. The four-tine grapple 100 is similar to the three-tine grapple 90 and the two-tine grapple 80 discussed above and includes a rotatable base 102. The rotatable base 102 has four integral support frame receivers 32' positioned at 90 degrees relative to each other for attaching each of the four claw tines 12 through the associated support frame 30.

Figure 24:
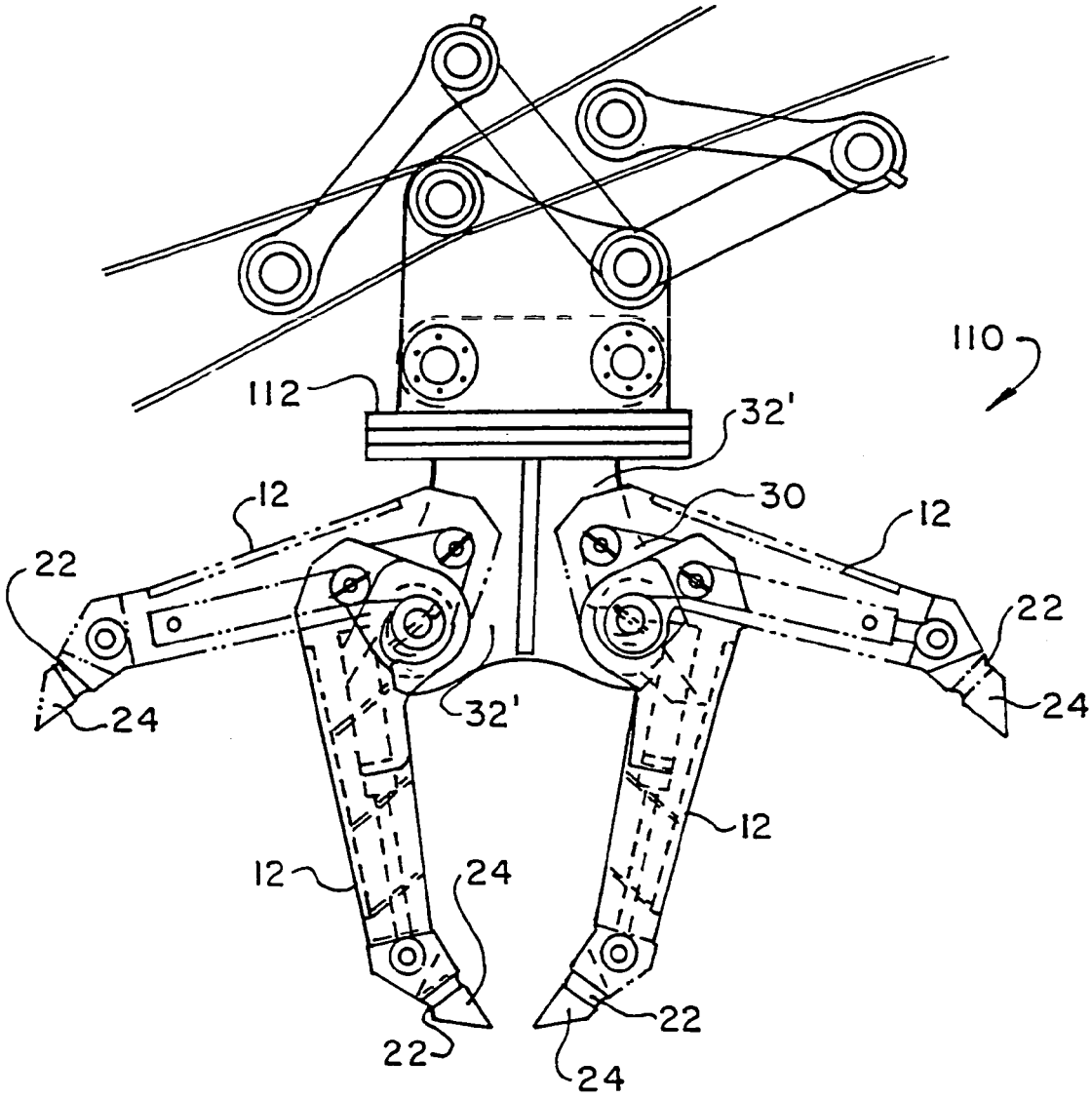
FIG. 24 is a side view of a claw structure grapple according to the present invention.
Figure 25:
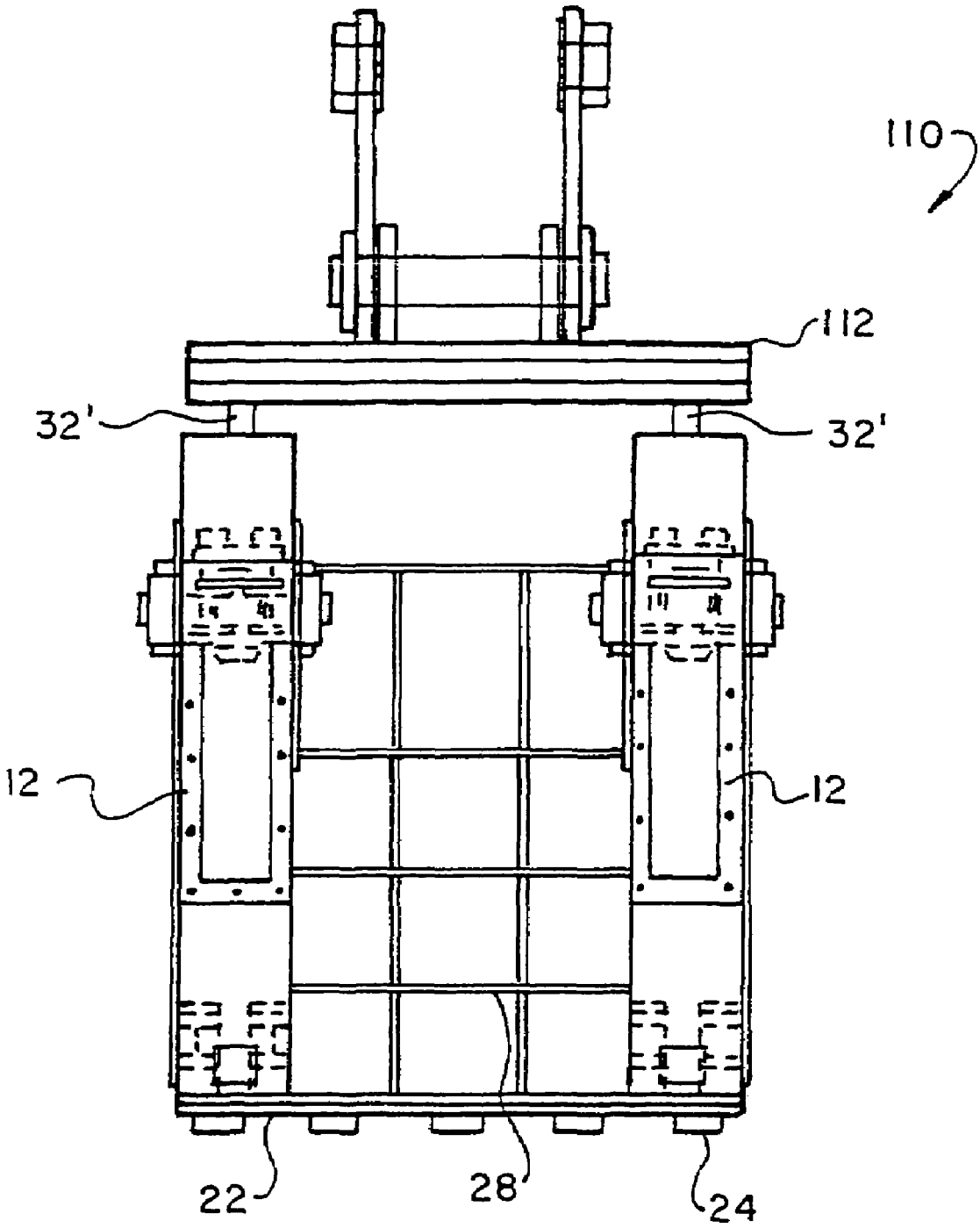
FIG. 25 is an end view of the claw structure grapple illustrated in FIG. 24.
Figure 26:
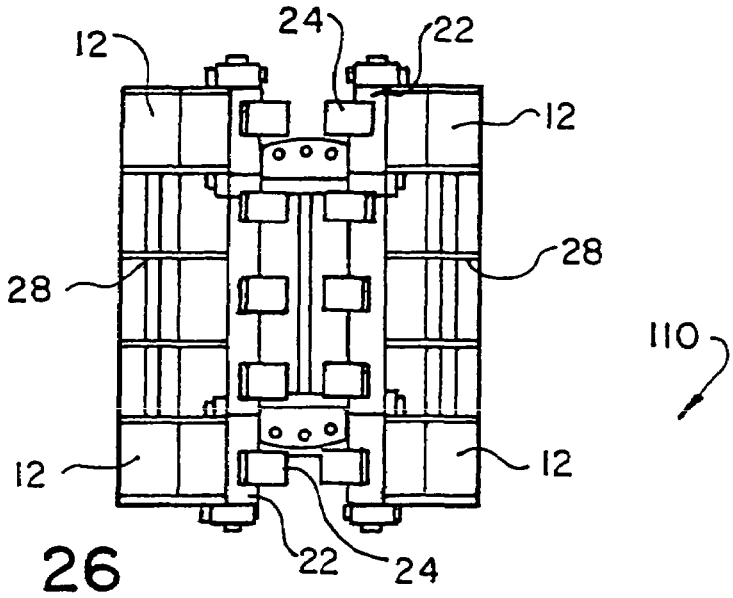
FIG. 26 is a bottom view of the claw structure grapple illustrated in FIG. 24.

FIGS. 24–26 illustrate a claw structure grapple 110 utilizing four claw tines 12. The claw structure grapple 110 includes a rotatable base 112 with two pairs of opposed integral support frame receivers 32' spaced from each other. The spaced set of opposed support frame receivers 32' allow for two sets of opposed claw tines 12 to be attached to the rotatable base 112. The claw tines 12 on each side of the rotatable base 112 will be secured together to form a claw structure similar to the claw structure on the bucket 10. Specifically, an end member 22 and grid 28 can be secured between the pair of parallel spaced claw tines 12 to form two opposed claw structures as best illustrated in FIGS. 25 and 26.

Figure 27:
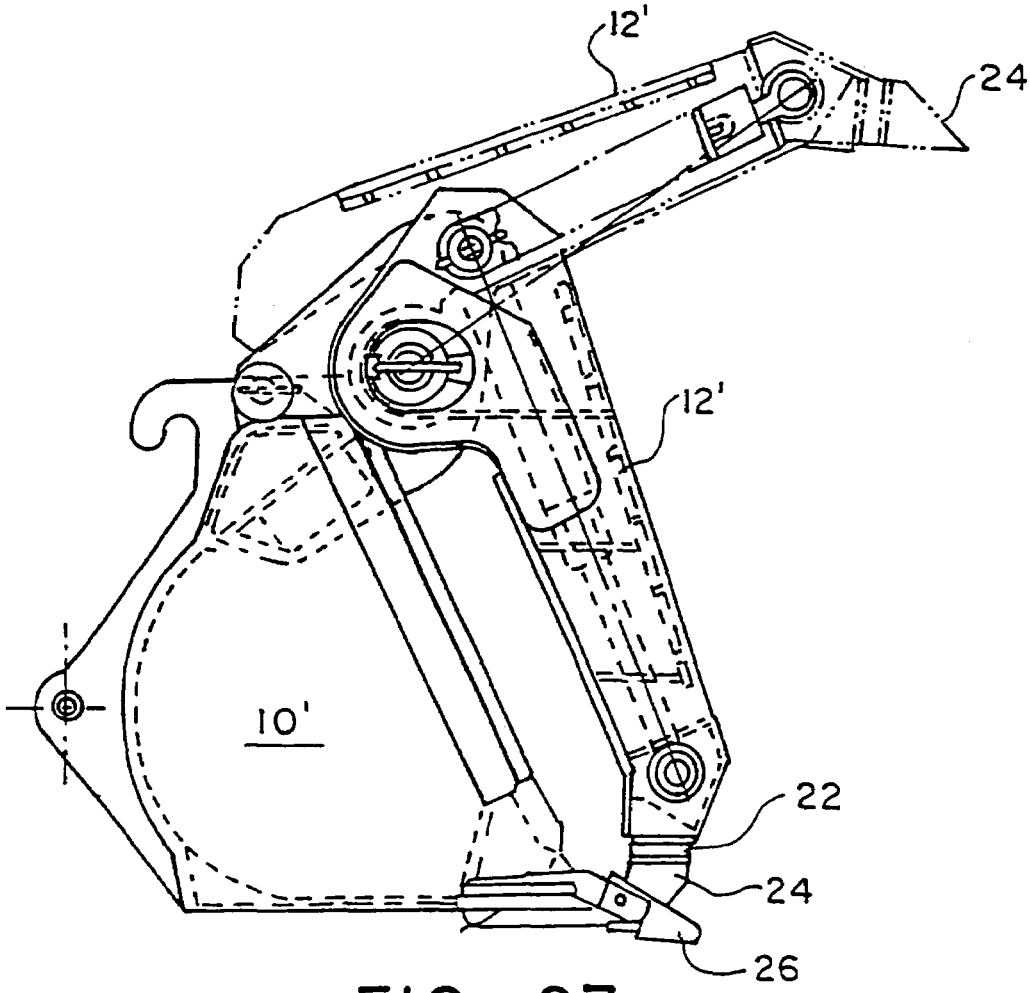
FIG. 27 is a side view similar to FIG. 3 of a bucket and claw structure according to the present invention.
Figure 28:
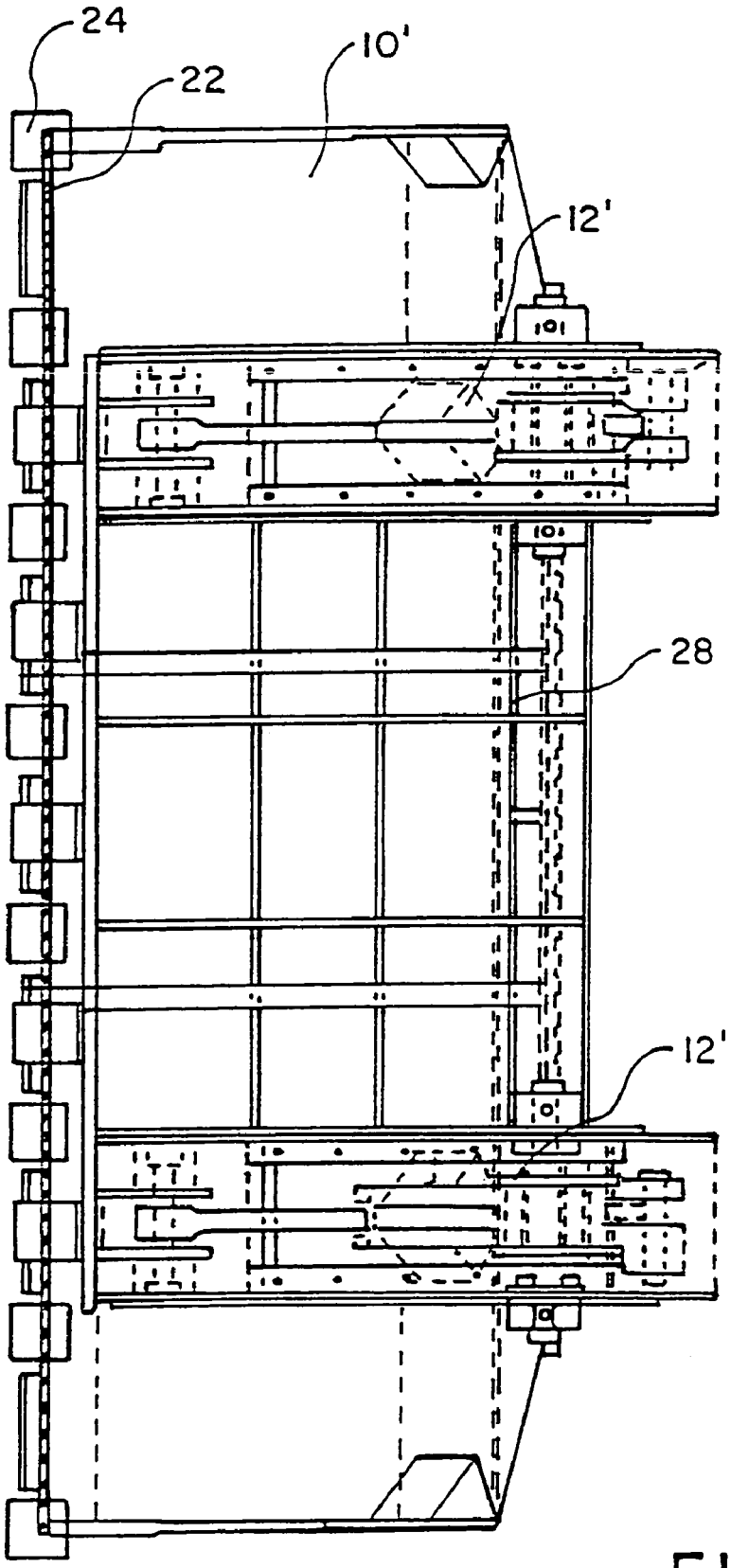
FIG. 28 is a front view of the bucket and claw structure illustrated in FIG. 27.

FIGS. 27 and 28 illustrate a claw tine 12' designed for a different sized bucket 10' than illustrated in FIG. 3. The embodiment illustrated in FIGS. 27 and 28 is intended to illustrate that changes in the size do not significantly effect the design of the overall claw tine 12 or 12'.

Figure 29:
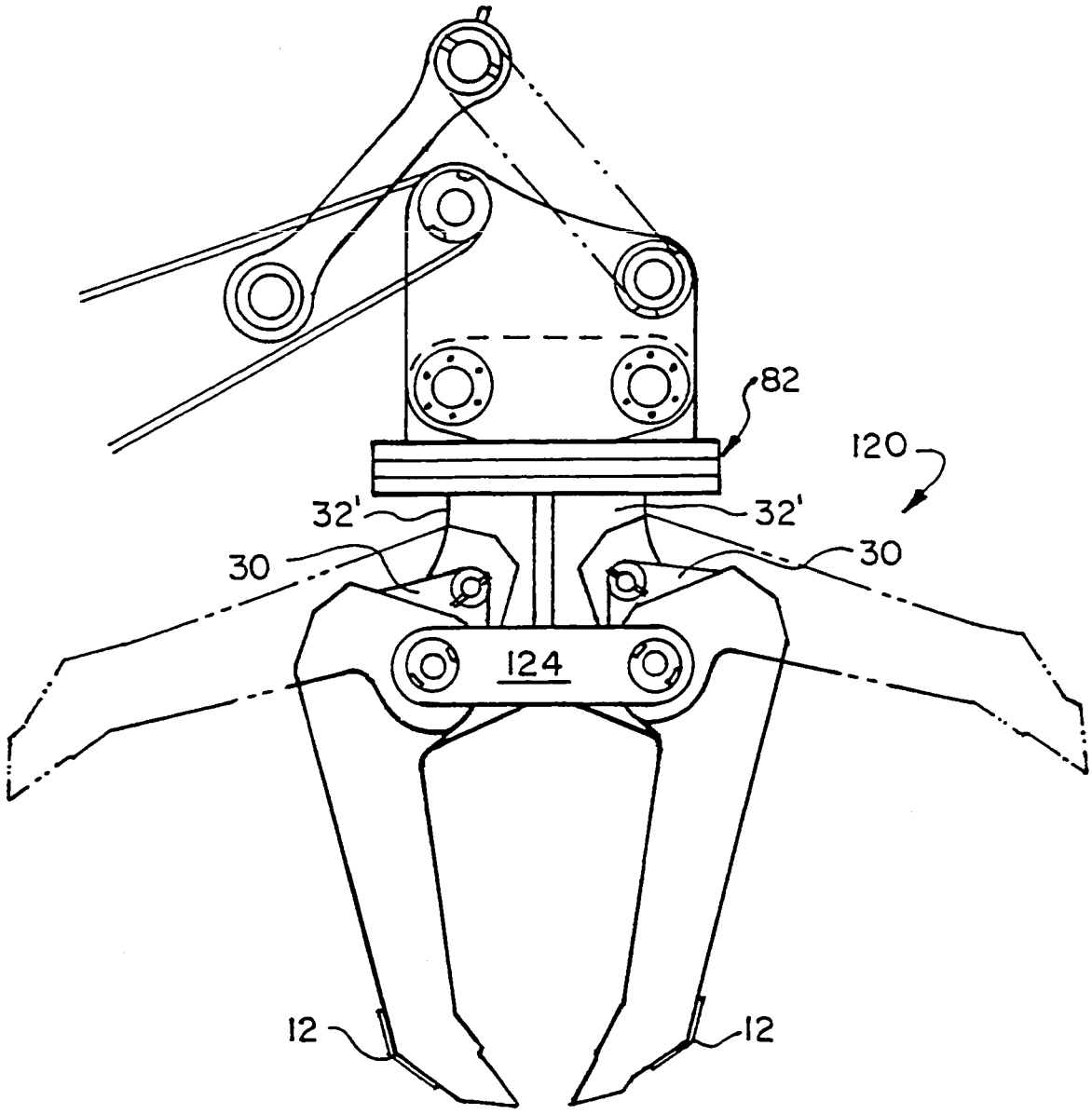
FIG. 29 is a side view of a two tine rotary grapple with outboard grates according to the present invention.
Figure 30:
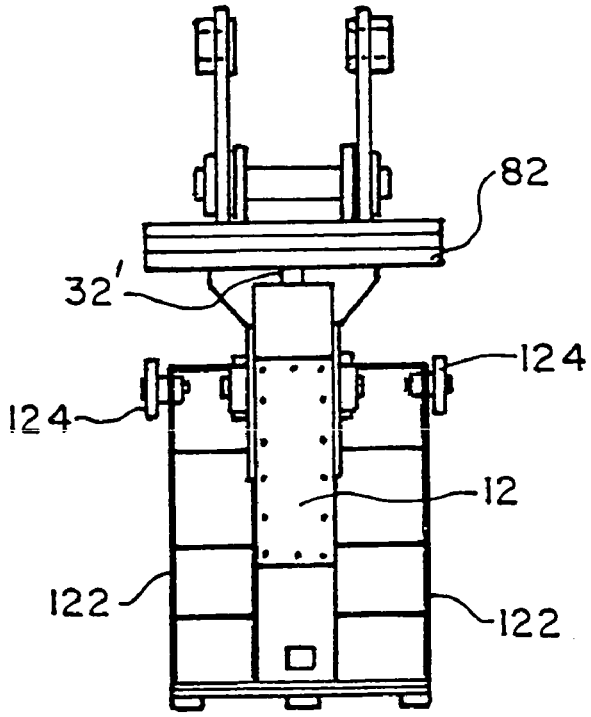
FIG. 30 is an end view of the two tine grapple illustrated in FIG. 29.

FIGS. 29 and 30 illustrate a two tine rotary grapple 120 utilizing the claw tines 12 of the present invention. The grapple 120 is similar to the grapple 80 of FIGS. 14–17 and includes the same rotatable base 82 having two integral support frame receivers 32'. Each claw tine 12 is attached to the rotatable base 82 through support frame 30 and support frame receiver 32' in the same manner discussed above in connection with bucket 10.

The grapple 120 includes a pair of outboard grates 122 mounted on the sides of each tine 12. A support linkage 124 extends between opposed outboard grates 122 for additional support. The support linkage 124 is attached about the pivot axis of each tine 12. Grapple 120 represents an alternative design for a grated claw structure.

Figure 32:
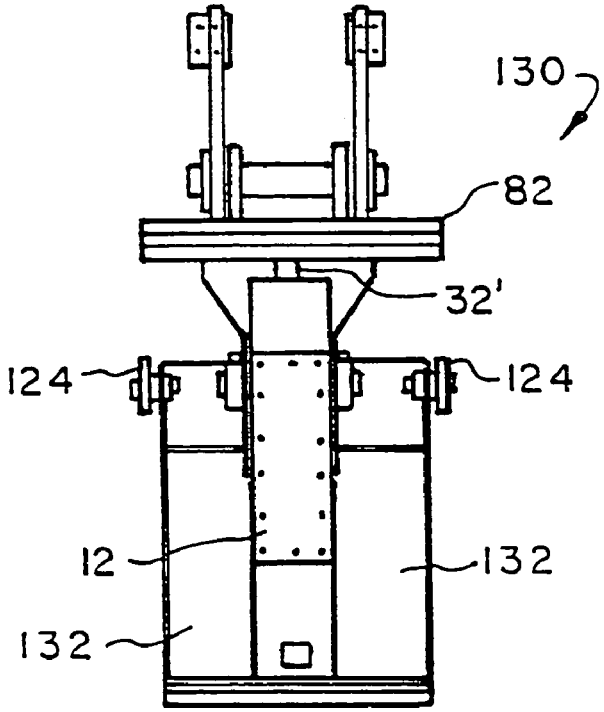
FIG. 32 is an end view of the two tine clamshell bucket illustrated in FIG. 31.
Figure 31:
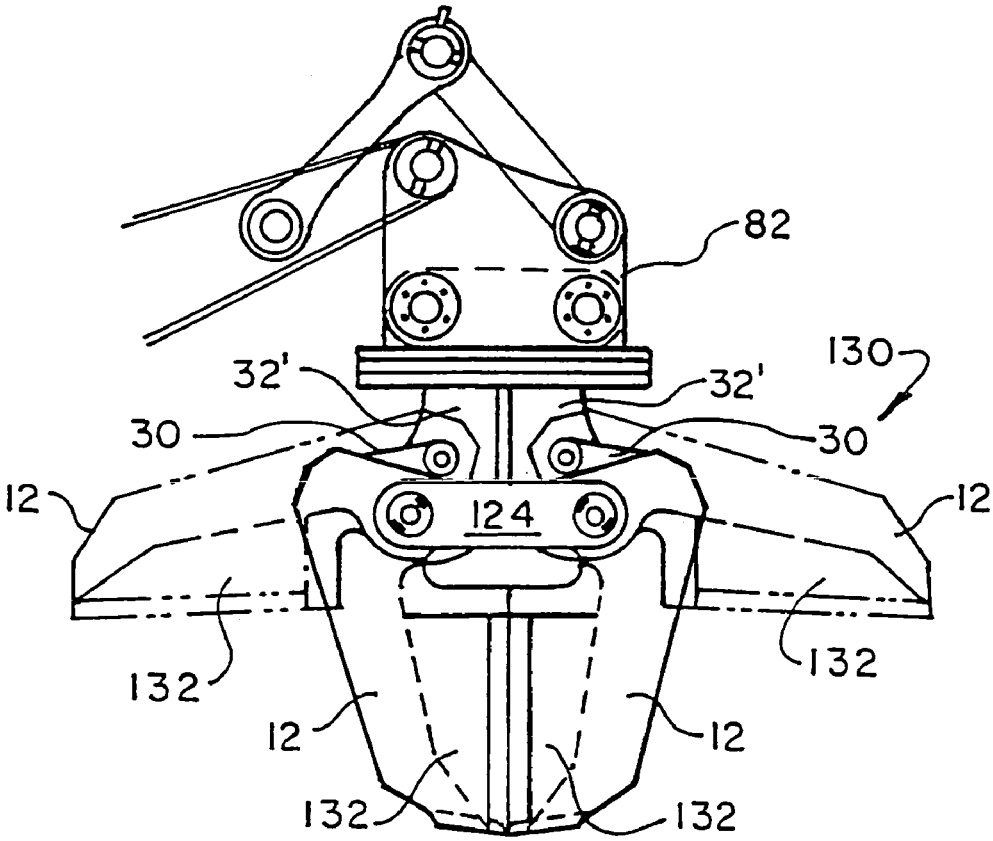
FIG. 31 is a side view of a two tine rotating clamshell bucket according to the present invention.
Figure 33:
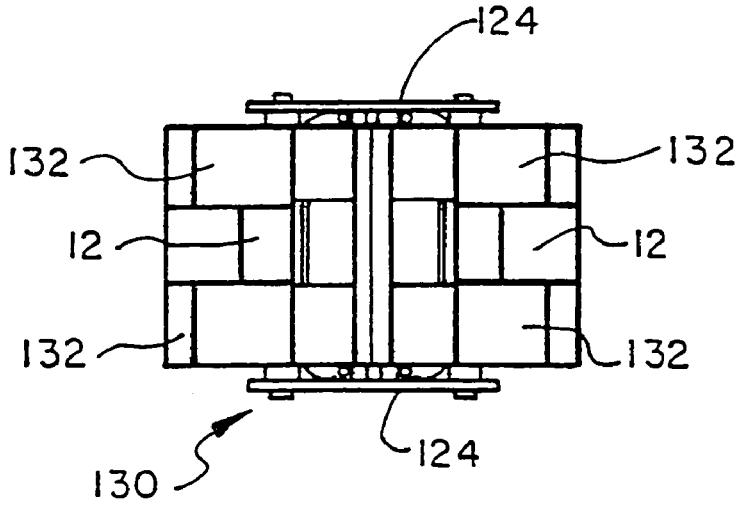
FIG. 33 is a bottom view of the two tine clamshell bucket illustrated in FIG. 31.

FIGS. 31–33 illustrate a two tine rotary clamshell bucket 130 utilizing the claw tines 12 of the present invention. The clamshell bucket 130 is similar to the grapple 120 of FIGS. 29–30 and includes the same rotatable base 82 having two integral support frame, receivers 32'. Each claw tine 12 is attached to the rotatable base 82 through support frame 30 and support frame receiver 32' in the same manner discussed above in connection with bucket 10.

The clamshell bucket 130 includes a pair of outboard bucket members 132 mounted on the sides of each tine 12. A support linkage 124 extends between opposed bucket members 132 for additional support. The support linkage 124 is attached about the pivot axis of each tine 12. The bucket members 132 are designed to combine with the tines 12 to form a generally closed bucket when in the closed position. The clamshell bucket 130 represents an alternative design for a tool which is adapted for granular type work or the like. The bucket members 132 extending from each side of the tine 12 could be replaced with a single bucket member for each tine 12 positioned in front or behind the tine 12, depending on the desired bucket size.

Figure 34:
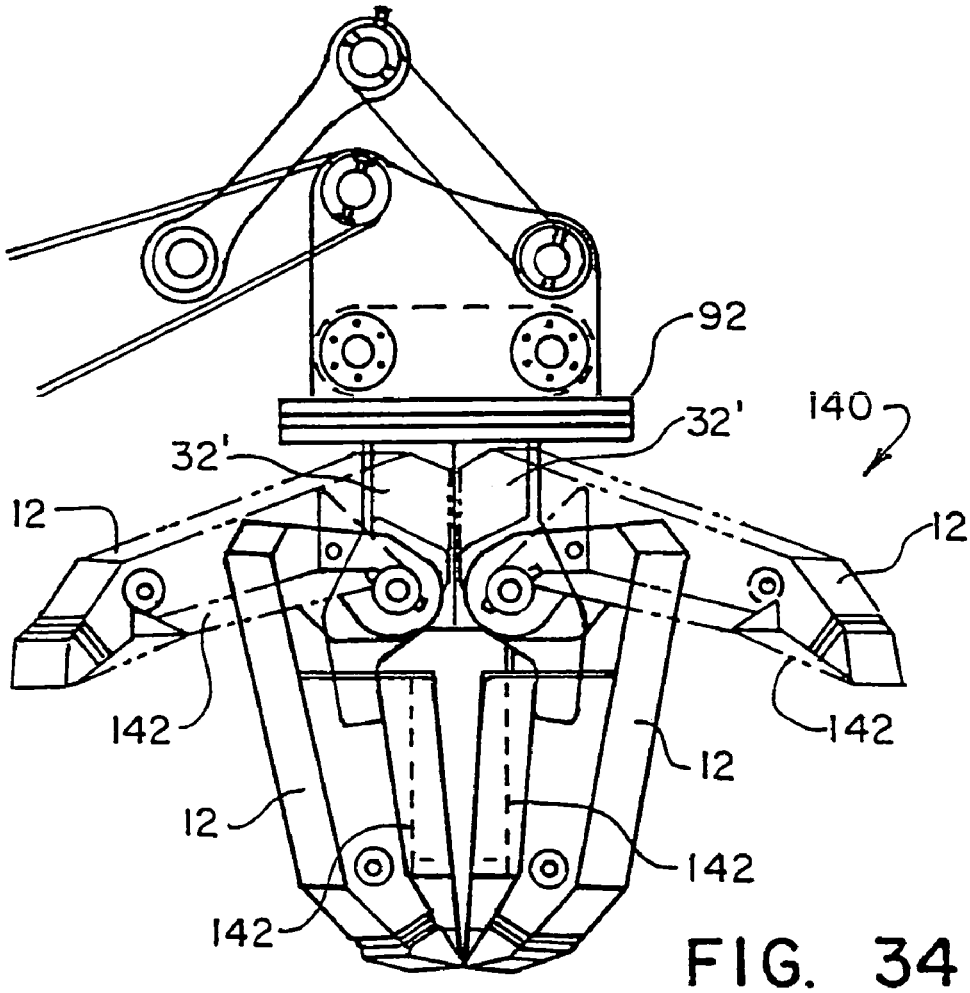
FIG. 34 is a side view of a three tine rotating orange peel grapple according to the present invention.
Figure 35:
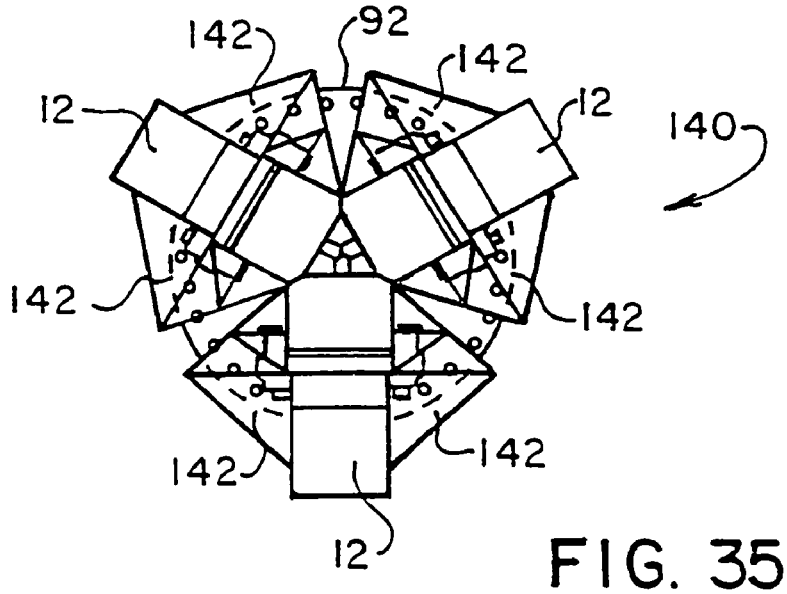
FIG. 35 is an end view of the three tine grapple illustrated in FIG. 34.

FIGS. 34 and 35 illustrate a three tine rotary orange peel grapple 140 utilizing the claw tines 12 of the present invention. The grapple 140 is similar to the grapple 90 of FIGS. 18–20 and includes the same rotatable base 92 having three integral support frame receivers 32' for mounting three claw tines 12. Each claw tine 12 is attached to the rotatable base 92 through support frame 30 and support frame receiver 32' in the same manner discussed above in connection with bucket 10.

The grapple 140 includes an orange peel bucket member 142 mounted on each tine 12. The bucket members 142 are designed to combine to form a generally closed bucket when the tines 12 are in the closed position. Grapple 140 represents an alternative design which is adapted for granular type work or the like. The bucket members 142 are positioned in front of the tines 12 but could be replaced with a pair of members extending from each side of the tine 12 or positioned behind the tine 12, depending on the desired bucket size. The orange peel refers to the shape of the individual bucket members 142.

Figure 37:
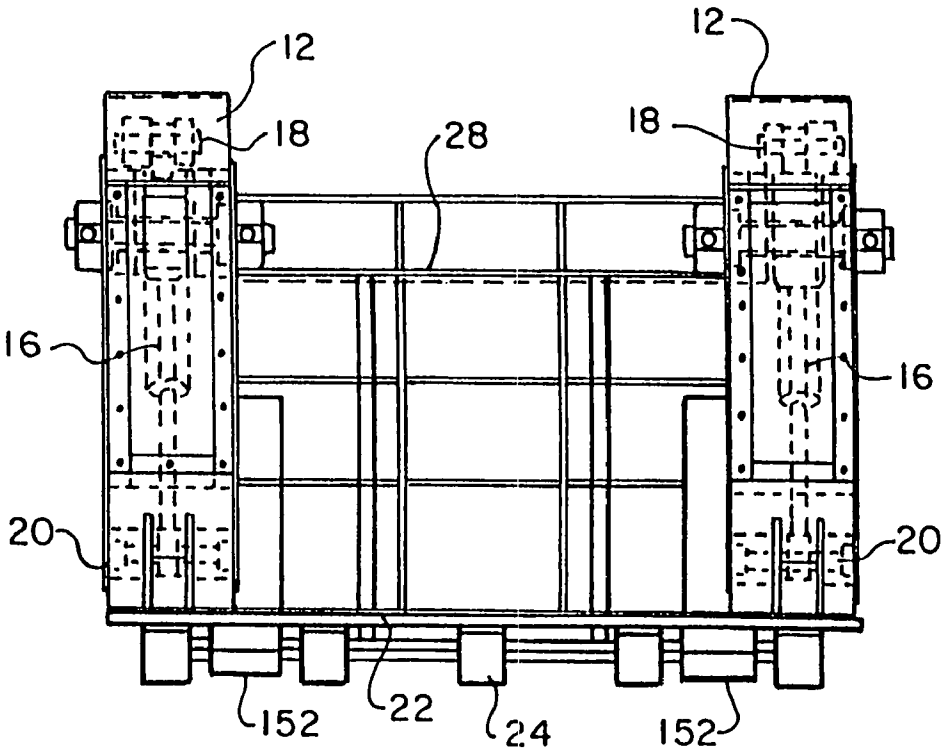
FIG. 37 is an end view of the two tine attachment for a pair of forks illustrated in FIG. 36.
Figure 36:
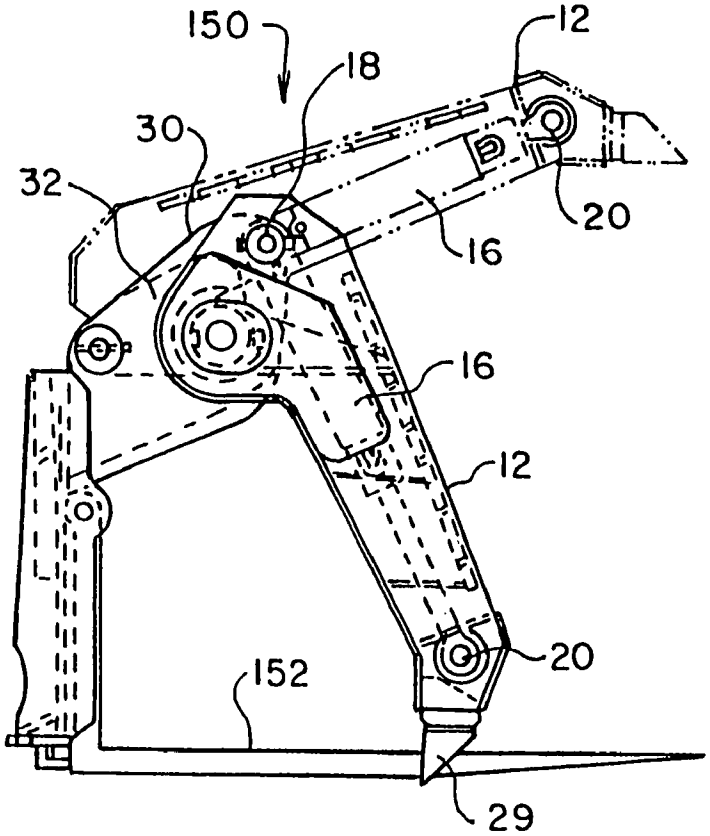
FIG. 36 is a side view of a two tine attachment for a pair of forks according to the present invention.

FIGS. 36 and 37 illustrate a fork assembly 150 including a pair of tines 12 forming a claw attachment for a conventional pair of forks 152. The claw attachment is substantially the same as the claw structure of FIG. 3 and the embodiment illustrated in FIGS. 27 and 28. FIGS. 36 and 37 illustrate further variations in tool design using the universal tine 12 of the present invention.

The design considerations discussed above provide an efficient and effective tine for use both in a bucket attachment and other configurations. The advantages of the present invention include a rugged construction which is adaptable to any bucket and in multiple tool configurations. The present design provides interchangeability among tool set components and for quick installation and removal of tool sets. The present invention provides a shielded power/hydraulic system. The use of a single support frame receiver 32 or 32' is believed to be significantly easier than prior art structures which require multiple plates and significant machining and modification to have the parallel plates properly positioned on an existing bucket. Additionally, the present invention contemplates providing a demolition equipment system in which the universal claw tine 12 can be utilized in a wide variety of demolition equipment units. As discussed in the above examples, the same set of four claw tines 12 can be utilized in various combinations to form a claw structure attachment for a bucket 10, a two-tine grapple 80, a three-tine grapple 90, a four-tine grapple 100, a claw structure grapple 110, a clamshell bucket 130, an orange peel grapple 140, or a claw structure for fork assembly 150. It is additionally contemplated that when using the claw structure for the bucket 10, the claw structure grapple 110, or the fork assembly 150 separate grids 28 can be utilized having different sized openings. The different sized openings in the different grids 28 can be utilized for segregating material in a sieve like fashion. The demolition equipment system provides a wide variety of equipment at a minimal capital cost. Additionally, the easy disassembly of the claw tines 12 from the respective demolition equipment units facilitates easy repair of the individual demolition equipment units.

In the meaning of the present invention, the bucket 10, rotatable base 82, rotatable base 92, rotatable base 102, rotatable base 112 and the forks 152 all form an equipment base for attachment of the claw tines 12. The above-described embodiments are intended to be illustrative of the present invention and not restrictive thereof. It will be apparent to those of ordinary skill in the art that various changes may be made to the present invention without departing from the spirit and scope thereof. The scope of the present invention is intended to be defined by the appended claims and equivalents thereto.

What is claimed is:

1. A demolition equipment system comprising:

a plurality of separate and distinct equipment bases, each equipment base forming at least a part of a separate and distinct demolition equipment unit, and each equipment base including a similarly configured support frame receiver; and a plurality of separate and distinct claw tines, each claw tine including a support frame configured to engage any of the support frame receivers such that each claw tine is selectively, removably attachable to any of the separate and distinct equipment bases for forming a part of each separate and distinct demolition equipment unit, and each claw tine is movable between an open and closed position.

2. The demolition equipment system of claim 1 wherein the plurality of separate and distinct equipment bases includes at least one bucket and at least one grapple base.

3. The demolition equipment system of claim 2 wherein the at least one grapple base is a two-tine grapple having a pair of claw tines opposed to each other and positioned 180 degrees from each other.

4. The demolition equipment system of claim 2 wherein the at least one grapple base is a three-tine grapple including three of the claw tines directed toward each other and positioned approximately 120 degrees apart from each other.

5. The demolition equipment system of claim 2 wherein the at least one grapple base is a four-tine grapple including four of the claw tines directed toward each other with each claw tine positioned 90 degrees apart from two adjacent claw tines.

6. The demolition equipment system of claim 1 wherein at least one of the demolition equipment units utilizes at least a pair of spaced, parallel claw tines coupled together to form a claw structure.

7. The demolition equipment system of claim 6 wherein the claw structure includes an end member extending between and attached to the spaced claw tines forming the tips of the claw tines.

8. The demolition equipment system of claim 1 wherein a claw structure of at least one of the demolition equipment units includes a grid assembly removably connected to at least one spaced claw tine.

9. A method of designing and forming a claw tine for demolition equipment comprising:

A) developing a general claw tine geometry which defines main geometric parameters of the claw tine;

B) analyzing the claw tine geometry to determine at least the relative holding force of the general claw tine throughout the range of motion of the general claw tine;

C) determining the relative value of main geometric parameters of the general claw tine which at least maximizes the holding force of the general claw tine in a desired angular rotation of the general claw tine; and D) forming a claw tine having the main geometric parameters determined in step C).

10. The method of claim 9 wherein the main geometric parameters of the general claw tine which are analyzed include a lever arm of the claw tine, a total force of the power driving the claw tine, and an angular position between the lever arm and the claw tine.

11. The method of claim 10 wherein the main geometric parameters of the general claw tine which are analyzed include a relative angular orientation of the lever arm to horizontal, and a vertical distance between a pivot point of the claw tine and the tip of the claw tine.

12. The method of claim 9 further including the step of analyzing the cycle time of the general claw tine and determining main geometric parameters of the claw tine to minimize cycle time.

13. The method of claim 9 wherein the maximum holding force is set when the claw tine is between about 25 degrees to 40 degrees from the closed position.

14. The method of claim 9 wherein a total angular rotation for the formed claw tine is between about 75 degrees to 100 degrees.

15. The method of claim 9 wherein the step of determining the relative value of main geometric parameters includes determining a geometric ratio between a length of a retracted hydraulic cylinder powering the claw tine to the distance between the pivot point of the claw tine and a cylinder rod end of the hydraulic cylinder is between 0.7 and 0.9.

16. The method of claim 9 wherein the step of determining the relative value of main geometric parameters includes varying the angular position of the lever arm, the distance between a pivot point of the claw tine and the cylinder rod end, and the angular position of the claw tine.

17. The method of claim 9 wherein the step of determining the relative value of main geometric parameters includes minimizing a vertical distance between an end of a piston rod of a hydraulic cylinder of the claw tine and the tip of the claw tine.

18. The method of claim 9 wherein the step of determining the relative value of main geometric parameters includes maximizing the vertical and horizontal distance between the pivot point of the claw tine and an end of the claw tine.

19. A claw tine for demolition equipment comprising:

an elongated claw tine body pivotally movable about a pivot point between an open position and a closed position;

a hydraulic cylinder for moving the claw tine body between the open position and the closed position;

a support frame for securing the claw tine to the demolition equipment, the support frame including a cylindrical bushing member defining a pivot point for the claw tine body, and at least one support frame plate attached to the bushing member, a locking pin aperture formed in the support frame plate for securing the support frame to the demolition equipment and a securing pin aperture formed in the support frame plate for securing a fixed end of the hydraulic cylinder to the support frame; and a support frame receiver attached to the demolition equipment, the support frame receiver formed as a single plate having an opening therein for supporting the bushing member and a locking pin aperture aligned with the locking pin aperture of the support frame for securing the support frame to the demolition equipment.

20. The claw tine of claim 19 wherein the support frame receiver includes an enlarged portion surrounding the opening supporting the bushing member, wherein the enlarged portion is wider than the adjacent portions of the support frame receiver.

21. The claw tine of claim 19 further including a removable claw tip at a distal end of the claw tine body.

22. The claw tine of claim 19 wherein the claw tine is adapted to have a total angular rotational value of at least 75 degrees.

23. A claw tine for demolition equipment comprising:

an elongated claw tine body pivotally movable about a pivot point between an open position and a closed position;

a claw tine at a distal end of the claw tine body; and a hydraulic cylinder for moving the claw tine body between the open position and the closed position, the hydraulic cylinder having a fixed end secured to a base and a cylinder rod end secured to the claw tine body, wherein a maximum holding force of the claw tine is positioned about one third of the total angular rotation of the claw tine body from the closed position.

24. The claw tine of claim 23 wherein the total angular rotation of the claw tine body between the open position and the closed position is at least 75 degrees.

25. The claw tine of claim 23 wherein the total rotation of the claw tine body between the open position and the closed position is between 75 and 100 degrees.

26. The claw tine of claim 23 wherein the hydraulic cylinder is substantially enclosed by the claw tine body.

27. A claw tine for demolition equipment comprising:

an elongated claw tine body pivotally movable about a pivot point between an open position and a closed position;

a support frame at a proximal end of the claw tine body and configured to engage a support frame receiver of the demolition equipment;

a tip at a distal end of the claw tine body; and a hydraulic cylinder for moving the claw tine body between the open position and the closed position, the hydraulic cylinder having a fixed end secured to a base and a cylinder rod end secured to the claw tine body at a location on the claw tine body proximate to the tip, wherein the total angular rotation of the claw tine body between the open position and the closed position is at least 75 degrees and wherein the hydraulic cylinder is enclosed and laterally protected by the claw tine body throughout the angular rotation of the claw tine body from the open position to the closed position.

28. The claw tine of claim 27 wherein the total rotation of the claw tine body between the open position and the closed position is between 75 and 100 degrees.

29. The claw tine of claim 27 wherein the total angular rotation of the claw tine is at least 85 degrees.

30. A demolition equipment system comprising:

a plurality of equipment bases, each equipment base forming at least a part of a separate and distinct demolition equipment unit; and a plurality of claw tines, each claw tine selectively, removably attachable to each equipment base for forming a part of each separate and distinct demolition equipment unit and movable between an open and closed position, wherein each claw tine includes an elongated claw tine body pivotally movable about a pivot point between the open position and the closed position, and a hydraulic cylinder for moving the claw tine body between the open position and the closed position, the hydraulic cylinder having a fixed end secured to a base and a cylinder rod end secured to the claw tine body, wherein the ratio of the length of the hydraulic cylinder when the claw tine body is in the closed position to the distance between the pivot point and the position where the cylinder rod end of the hydraulic cylinder is secured to the claw tine body is in the range of between 0.7 and 0.9.

31. A demolition equipment system comprising:

a plurality of equipment bases, each equipment base forming at least a part of a separate and distinct demolition equipment unit; and a plurality of claw tines, each claw tine selectively, removably attachable to each equipment base for forming a part of each separate and distinct demolition equipment unit and movable between an open and closed position, wherein each claw tine includes an elongated claw tine body pivotally movable about a pivot point between the open position and the closed position, a hydraulic cylinder for moving the claw tine body between the open and the closed position, a support frame for securing the claw tine to the demolition equipment unit, the support frame including a cylindrical bushing member defining a pivot point for the claw tine body, and at least one support frame plate attached to the bushing member, a locking pin aperture formed in the support frame plate for securing the support frame to the demolition equipment unit and a securing pin aperture formed in the support frame plate for securing a fixed end of the hydraulic cylinder to the support frame, and a support frame receiver attached to the demolition equipment unit, the support frame receiver formed as a single plate having an opening therein for supporting the bushing member and a locking pin aperture aligned with the locking pin aperture of the support frame for securing the support frame to the demolition equipment unit.

32. A claw tine for demolition equipment comprising:

an elongated claw tine body pivotally movable about a pivot point between an open position and a closed position;

a claw tine at a distal end of the claw tine body; and a hydraulic cylinder for moving the claw tine body between the open position and the closed position, the hydraulic cylinder having a fixed end secured to a base and a cylinder rod end secured to the claw tine body, wherein the total angular rotation of the claw tine body between the open position and the closed position is at least 75 degrees, wherein the ratio of the length of the hydraulic cylinder when the claw tine body is in the closed position to the distance between the pivot point and the position where the cylinder rod end of the hydraulic cylinder is secured to the claw tine body is in the range of between 0.7 and 0.9.

33. A claw tine for demolition equipment comprising:

an elongated claw tine body pivotally movable about a pivot point between an open position and a closed position;

a claw tine at a distal end of the claw tine body; and a hydraulic cylinder for moving the claw tine body between the open position and the closed position, the hydraulic cylinder having a fixed end secured to a base and a cylinder rod end secured to the claw tine body, wherein the total angular rotation of the claw tine body between the open position and the closed position is at least 75 degrees, wherein a maximum holding force of the claw tine is positioned between 25 and 40 degrees from the closed position.

34. A claw tine for demolition equipment comprising:

an elongated claw tine body pivotally movable about a pivot point between an open position and a closed position;

a claw tine at a distal end of the claw tine body;

a hydraulic cylinder for moving the claw tine body between the open position and the closed position, the hydraulic cylinder having a fixed end secured to a base and a cylinder rod end secured to the claw tine body, wherein the total angular rotation of the claw tine body between the open position and the closed position is at least 75 degrees, and a support frame for securing the claw tine to the demolition equipment unit, the support frame including a cylindrical bushing member defining a pivot point for the claw tine body, and at least one support frame plate attached to the bushing member, a locking pin aperture formed in the support frame plate for securing the support frame to the demolition equipment unit and a securing pin aperture formed in the support frame plate for securing a fixed end of the hydraulic cylinder to the support frame, and a support frame receiver attached to the demolition equipment unit, the support frame receiver formed as a single plate having an opening therein for supporting the bushing member and a locking pin aperture aligned with the locking pin aperture of the support frame for securing the support frame to the demolition equipment unit.

* * * * *